US011203505B2

(12) United States Patent
Enomoto

(10) Patent No.: US 11,203,505 B2
(45) Date of Patent: Dec. 21, 2021

(54) SHEET FOLDING PROCESSING DEVICE AND IMAGE FORMING SYSTEM HAVING THE SAME

(71) Applicant: Shinnosuke Enomoto, Yamanashi-ken (JP)

(72) Inventor: Shinnosuke Enomoto, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/709,176

(22) Filed: Dec. 10, 2019

(65) Prior Publication Data

US 2020/0180894 A1 Jun. 11, 2020

(30) Foreign Application Priority Data

Dec. 10, 2018 (JP) ..... JP2018-230533

(51) Int. Cl.
*B65H 37/06* (2006.01)

(52) U.S. Cl.
CPC ..... *B65H 37/06* (2013.01)

(58) Field of Classification Search
CPC ..... B65H 37/06; B65H 2701/13212; B65H 2301/51232; B65H 2701/11232; B65H 45/18; B65H 45/04; B65H 45/30; G03G 2215/00877
See application file for complete search history.

(56) References Cited

U.S. PATENT DOCUMENTS

| | | | | |
|---|---|---|---|---|
| 9,260,268 | B2 * | 2/2016 | Sugiyama | B65H 45/04 |
| 9,688,503 | B2 * | 6/2017 | Fukasawa | B65H 45/18 |
| 9,932,199 | B2 * | 4/2018 | Katsumata | B65H 45/18 |
| 10,087,035 | B2 * | 10/2018 | Hama | B65H 29/125 |
| 2014/0171285 | A1 * | 6/2014 | Farlotti | B65H 45/18 493/444 |
| 2016/0185564 | A1 * | 6/2016 | Awano | B29C 53/06 493/434 |
| 2017/0217714 | A1 * | 8/2017 | Horiguchi | B65H 45/18 |

FOREIGN PATENT DOCUMENTS

| | | |
|---|---|---|
| JP | 2012-153525 A | 8/2012 |
| JP | 2012-171727 A | 9/2012 |

* cited by examiner

*Primary Examiner* — Patrick H Mackey
(74) *Attorney, Agent, or Firm* — Manabu Kanesaka

(57) ABSTRACT

A sheet folding processing device includes a folding processing mechanism that includes a folding roller pair for forming a plurality of folds on the sheet conveyed in a predetermined sheet conveying direction to produce Z-fold, additional folding rollers and a lower folding guide. The additional folding rollers and the lower folding guide are arranged on the downstream side of the folding roller pair in the sheet conveying direction to face each other and cooperate with each other to press the folds. The interval between the folding roller pair and the additional folding rollers is determined such that when the leading fold as viewed in the sheet conveying direction is pressed between the additional folding rollers and the lower folding guide, the sheet part having a plurality of layers of sheet where the sheet is folded between the additional folding rollers can also be held between the folding roller pair.

12 Claims, 9 Drawing Sheets

SHEET FOLDING PROCESSING DEVICE AND IMAGE FORMING SYSTEM HAVING THE SAME

CROSS-REFERENCE TO RELATED APPLICATION

The present application is based on and claims priority of Japanese Patent Application No. 2018-230533 filed on Dec. 10, 2018, the disclosure of which is incorporated herein.

BACKGROUND OF THE INVENTION

Field of the Invention

This invention relates to a sheet folding processing device for executing a sheet folding process on a sheet and also to an image forming system of a copying machine, a printing machine, a facsimile machine, a composite machine of such machines or the like that comprises such a sheet folding processing device.

Description of the Related Background Art

There is conventionally known a sheet folding processing device (post-processing device) installed in an image forming system of a copying machine, a printing machine or the like and designed to execute a sheet folding process once by means of the sheet folding processing section thereof to produce one or more than one folds and subsequently and additionally press (execute an additional folding process on) the one or more than one folds, whichever appropriate, by means of a separate press member for the purpose of preventing the thickness (height) of the folded part formed on the sheet by means of the sheet folding processing section from remarkably increasing.

For example, JP 2012-171727 A discloses a sheet folding device designed to operate such that, in a process of folding each of the sheets (of paper) that are being continuously conveyed in, the preceding sheets that have been folded are temporarily stacked in another conveyance route and, after the end of the operation of folding the succeeding sheets, the stacked preceding sheets and the succeeding sheets are conveyed to an additional sheet folding section, where a repress roller is driven to move on and along the folds of the preceding sheets and the succeeding sheet laid on the preceding sheets in a direction intersecting the direction of conveying the sheets in order to repress both the folded parts (folds) of the preceding sheets and those of the succeeding sheets.

Additionally, JP 2012-153525 A discloses a paper sheet folding processing device designed to operate such that, in a process of producing a plurality of folds, which may be as a process of inwardly folding a sheet (of paper) into three, on each of the sheets (of paper) that are being continuously conveyed in, the rear end side fold formed on a preceding sheet by the folding processing device main section as viewed in the sheet conveying direction and the front end side fold formed on the immediately succeeding sheet by the folding processing device main section as viewed in the sheet conveying direction are arranged side by side in the sheet conveying direction and an additional press is simultaneously applied to those folds by the press section of the device for an additional press process.

A sheet folding device disclosed in JP 2012-171727 A is accompanied by a problem that inevitably the device is made to show a large size and requires high manufacturing cost because an additional conveyance route and an additional space need to be provided in order to stack the preceding sheets.

In a paper sheet folding processing device disclosed in JP 2012-153525 A, the press roller of the press section of the device is provided with a pair of protrusions that show a substantially spiral profile and are substantially linearly symmetrically arranged by referring to the center position of the sheet in the width direction so as to apparently be directed toward the opposite ends in the width direction for the purpose of preventing the pressing force applied by the press section from being dispersed in the additional folding process. Therefore, the press roller to be used for the additional press process is required to have a large diameter so that the entire device can inevitably be made to show a large size. Additionally, as the press roller for the additional press process is made to show a large size, the folding roller for executing a folding process in the folding processing device main section and the press roller for an additional folding process need to be separated from each other by a large distance in order to prevent the folding roller and the press roller from contacting each other. Then, in an operation of producing a plurality of folds that are located close to each other as in an instance of producing a Z-fold sheet, the folding roller may not be able to hold the folded parts of the Z-fold sheet for the purpose of executing an additional folding process. As a result, the folded parts of a sheet can be displaced from each other to give rise to a possibility that an additional folding process is executed at a position different from the folded parts produced by the folding roller.

Therefore, the object of the present invention is to provide a sheet folding processing device that can accurately execute an additional folding process than ever and, at the same time, suppress the need of increasing the size of the device.

SUMMARY OF THE INVENTION

In view of the above-identified object of the present invention, in the first aspect of the present invention, there is provided a sheet folding processing device for executing an additional folding (press) process on a Z-fold sheet having a plurality of folds formed by a folding process and being conveyed in a predetermined conveyance direction, the device comprising: a folding processing section for forming a plurality of folds on a sheet; a pair of holding members capable of holding the sheet having the plurality of the folds formed thereon; a plurality of first press members arranged along the running direction of the folds on the downstream side relative to the pair of holding members as viewed in the conveyance direction; a second press member arranged vis-a-vis the plurality of first press members to press the folds in cooperation with the plurality of first press members; and a moving mechanism for moving the first press members between a press position and a retreat position such that the moving mechanism moves the first press members relative to the second pressure member so as to bring it closer to the second press member until they get to the press position and press the folds arranged between the first press members and the second pressure member and then moves the first press members relative to the second pressure member from the press position to the retreat position in a direction of moving away from the sheet, and also for moving the first press members relative to the second press member along the folds in a state where the first press members have been moved relative to the second pressure member so as to get to the press position; the interval between the pair of holding members and the first press members as viewed in the conveyance direction being so determined that, when the leading fold as viewed in the conveyance direction is pressed between the plurality of first press members located at the press position and the second press member, the sheet part where the sheet is folded to form a plurality of layers in order to produce the Z-fold can be held between the pair of holding members.

Thus, a sheet folding processing device as described above can execute an additional folding process on the folds, which have been produced by the folding processing section of the device, of the sheet being conveyed by arranging the folds between the first press members and the second press member and moving the first press members in the state of having been moved to the press position relative to the second pressure member along the folds. Additionally, when an additional folding process is executed on the folds between the first press members and the second press member, the sheet part where the sheet is folded to form a plurality of layers is also held between the pair of holding members so that the relative position of the sheet part where the sheet is folded can hardly be displaced and hence any possible displacement of the folds produced by the folding processing section is suppressed to make it possible to accurately execute an additional folding process on the folds of the sheet. Furthermore, since the additional folding process is executed by moving the first press members, which are arranged in a row, relative to the second press member in the running direction of the folds of the sheet in a state where the first press members have been moved to the press position, the width of the first press members can be made small in the sheet conveying direction. Still additionally, since the sheet part where the sheet is folded can be held between the first press members and the second press member and also between the pair of holding members and at the same time the width of the first press members can be made small as described above, the first press members, the second press member and the pair of holding members can be arranged at short intervals.

In the above-described sheet folding processing device, preferably the folding processing section has a pair of rollers for forming folds on the sheet that is being conveyed and the pair of rollers is make to take the role of the pair of holding members. When the pair of rollers takes the role of the pair of holding members, no new members need to be added to hold sheet so that the effect of suppressing the need of increasing the size of the device can further be improved, while the device can keep its ability of accurately executing a folding process.

Besides, preferably, the first press members are rotating bodies that rotate around respective axes of rotation extending in the conveyance direction and press the folds. With such an arrangement, if the rotating bodies have a large diameter, the rotating bodies and the pair of holding members can be placed in close proximity relative to each other by reducing the width of the rotating bodies in the conveyance direction and hence it is possible to downsize the folding processing device.

In a preferable embodiment of sheet folding processing device according to the present invention, the plurality of first press members are arranged on the side that faces the leading fold of the sheet as viewed in the conveyance direction. With such an arrangement, the first press members can directly contact the leading fold of the sheet in the conveyance direction to apply pressing force and the pressing force can be prevented from being dispersed by the sheet part that is otherwise located between the first press members and the fold so that it is possible to reliably strengthen the fold and, at the same time, displacement of the succeeding part of the sheet can hardly take place.

In the above-described sheet folding processing device, a pair of conveyance members are additionally arranged on the downstream side of the plurality of first press members as viewed in the conveyance direction and the interval between the pair of conveyance members and the plurality of first press members in the conveyance direction is preferably so determined that, when the fold located next to the leading fold in the conveyance direction is pressed between the plurality of first press members at the press position and the second press member, the sheet part where the sheet is folded to form a plurality of layers between the position first folding members and the second folding member can be held between the pair of conveyance members.

Additionally, in the second aspect of the present invention, there is provided an image forming system comprising an image forming device for forming an image on a sheet and subsequently carrying away the sheet on which the image has been formed and a sheet folding processing device as defined above for executing a folding process on the sheet carried away from the image forming device.

According to the present invention, when an additional folding process is executed on the folds located between the first press members and the second press member, since the sheet part where the sheet is folded to form a plurality of layers is held between the pair of conveyance members, it is possible to accurately execute an additional folding process on the folds of the sheet without allowing the folds formed by the folding processing section to be displaced. Additionally, since the additional folding process is executed on the folds of the sheet by moving the first press members relative to the second press member in the direction in which the folds extend, it is possible to reduce the width of the first press members in the sheet conveying direction so that the device can be downsized. Furthermore, since the first press members, the second press member and the pair of holding members are arranged at short intervals, it is possible to suppress the need of increasing the size of the device due to the provision of the pair of holding members.

BRIEF DESCRIPTION OF THE DRAWINGS

FIGS. 5A to 5D are an explanatory graphic illustration of the operation of the additional folding section of executing an additional folding process on a sheet in the additional folding unit, in which FIG. 5A shows a state where the first fold located on the leading edge side of the sheet as viewed in the sheet carrying in direction is received in the additional folding section, FIG. 5B shows a state where the additional folding rollers are moved to the press position shown in FIG. 5B and the first fold of the sheet is pressed by the additional folding rollers, FIG. 5C shows a state where the additional processing rollers are moved along the first fold of the sheet at the press position shown in FIG. 5B and FIG. 5D shows a state where the additional press rollers are moved to the first retreat position from the state shown in FIG. 5C.

FIGS. 6E to 6H is an explanatory graphic illustration of the operation of the additional folding section of executing an additional folding process on a sheet in the additional folding unit, in which FIG. 6E shows a state where the second fold located on the trailing edge side of the sheet as viewed in the sheet carrying in direction is received in the additional folding section, FIG. 6F shows a state where the additional folding rollers are moved to the press position and the second fold of the sheet is pressed by the additional folding rollers, FIG. 6G shows a state where the additional processing rollers are moved along the second fold of the sheet at the press position shown in FIG. 6F and FIG. 6H shows a state where the additional press rollers are moved to the second retreat position from the state shown in FIG. 6G.

DESCRIPTION OF THE PREFERRED EMBODIMENTS

Now, preferable embodiments of the present invention will be described below by referring to the accompanying drawings.

Firstly, the overall configuration of an image forming system comprising a sheet folding processing device according to the present invention will be described below by referring to FIG. 1. The image forming system comprises an image forming device A, a sheet folding processing device B and a post-processing device C. The image forming device A forms an image on a sheet and subsequently the sheet folding processing device B executes a folding process on the sheet on which the image has been formed by the image forming device A. Thereafter, if necessary, the post-processing device C executes a stapling process and/or an aligning process and discharges the sheet into the storage tray 27 arranged on the downstream side. Image forming systems includes, for example, copying machines, printing machines and other machines having various different structures. Now, the image forming device A, the sheet folding processing device B and the post-processing device C will be described in detail below.

[Image Forming Device]

Figure 1:
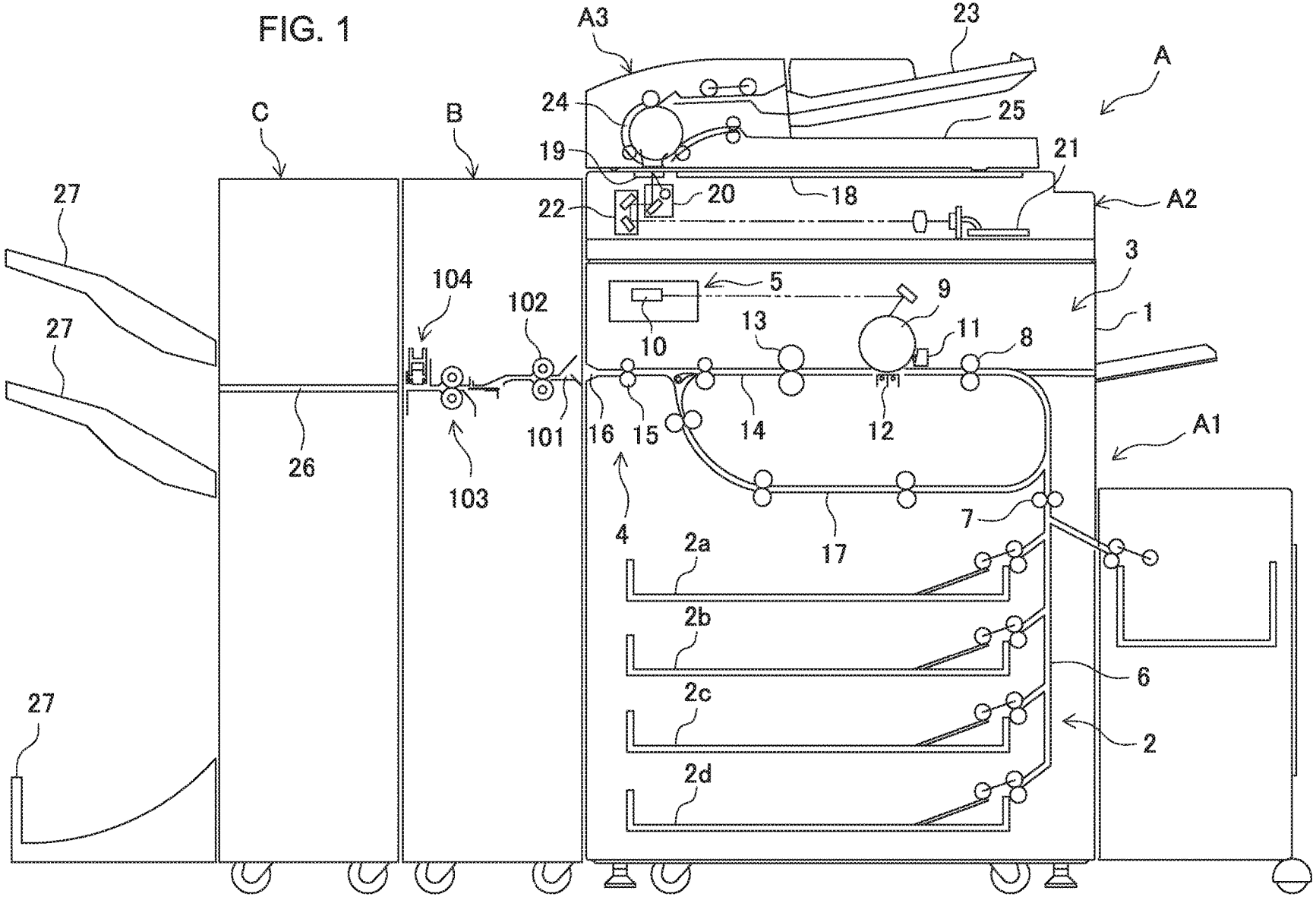
FIG. 1 is a schematic graphic illustration of an image forming system comprising a folding processing device according to the present invention, showing the overall configuration of the system.

As illustrated in FIG. 1, the image forming device A includes an image forming unit A1, an image reading unit A2 and a document feeding unit A3. The image forming unit A1 has, in a device housing 1, a sheet feeding part 2, an image forming part 3, a sheet discharge part 4 and a data processing part 5.

The sheet feeding part 2 includes a plurality of cassettes 2*a*, 2*b*, 2*c* and 2*d*. The cassettes 2*a*, 2*b*, 2*c* and 2*d* can individually store therein sheets S of different standard sizes selected ahead of time, respectively. Each of the cassettes 2*a*, 2*b*, 2*c*, and 2*d* incorporates a separating mechanism for separating the sheets S therein one from another and a sheet feeding mechanism for delivering the sheet S. The thus configured sheet feeding part 2 delivers the sheet S of a size specified by a main body control part (not illustrated) to a sheet feeding path 6. In the sheet feeding path 6, a conveying roller 7 and a resist roller 8 are provided. The conveying roller 7 is disposed at the intermediate portion of the sheet feeding path 6 and configured to convey downstream the sheet S supplied from the plurality of cassettes 2*a*, 2*b*, 2*c* and 2*d*. The resist roller 8 is disposed at the end portion of the sheet feeding path 6 and is configured to align the sheets S at their leading ends. The sheets S aligned at their leading ends by the resist roller 8 is fed to the image forming part 3 on the downstream side at a predetermined timing.

The image forming part 3 may be configured at least to form an image on the sheet S fed from the sheet feeding part 2, and various image forming mechanisms can be adopted as the image forming part 3. In the illustrated embodiment, an electrostatic type image forming mechanism is exemplified as the image forming part 3. However, the image forming part 3 is not limited to such an electrostatic type image forming mechanism as illustrated, but an inkjet type image forming mechanism, an offset type image forming mechanism and the like can be adopted as the image forming part 3.

The image forming part 3 illustrated in FIG. 1 is provided with a photoreceptor 9 (drum, belt) and a light emitter 10 that emits optical beam to the photoreceptor 9, and a developer 11 and a cleaner (not illustrated) are disposed around the rotating photoreceptor 9. The illustrated example is a monochrome print mechanism, wherein a latent image is optically formed on the photoreceptor 9 by the light emitter 10, and toner ink is applied to the latent image by the developer 11. The ink image (ink toner) applied onto the photoreceptor 9 is image-transferred, by a transfer charger 12, onto the sheet S fed from the sheet feeding part 2, and the image-transferred sheet S is subjected to image-fixing by a fixing roller 13. The resultant sheet S is fed to a sheet discharge path 14. Further, a circulation path 17 is provided in the image forming part 3, wherein the sheet S from the sheet discharge path 14 is turned upside down in a switch-back path and is fed once again to the resist roller 8, then subjected to image formation on the back surface, and fed to the sheet discharge path 14. The sheet discharge path 14 has a sheet discharge roller 15, and a sheet discharge port 16 is formed at the end thereof. The image-formed sheet S is conveyed by the sheet discharge roller 15 to the folding device B through the sheet discharge port 16.

The image reading unit A2 is provided above the thus configured image forming unit A1. The image reading unit A2 is configured to optically read a document image formed in the image forming part 3. Further, the document feeding unit A3 is mounted on the image reading unit A2.

The image reading unit A2 includes first and second platens 18 and 19 each made of a transparent glass, a reading carriage 20, a light source mounted on the reading carriage 20, a photoelectric conversion element 21 and a reduction optical system 22 constituted by combining a mirror and a lens. In the image reading unit A2, the image on the document sheet S placed on the first platen 18 is irradiated with light from the light source while the reading carriage 20 is moved along the first platen 18, and reflected light from the image on the document sheet S is guided by the reduction optical system 22 to the photoelectric conversion element 21, whereby the image on the document sheet S is read. The photoelectric conversion element 21 converts read image data into an electric signal and transfers the obtained electric signal to the image forming part 3.

The document feeding unit A3 includes a sheet feeding tray 23, a sheet feeding path 24 and a sheet discharge tray 25. In the document feeding unit A3, documents placed on the sheet feeding tray 23 are fed one by one along the sheet feeding path 24, made to pass on the second platen 19, and discharged to the sheet discharge tray 25. When the document fed from the sheet feeding tray 23 and passing on the second platen 19 is read, the reading carriage 20 is stopped ahead of time below the second platen 19, and image data is generated from the image passing on the second platen 19.

[Post-Processing Device]

The post-processing device C is connected to the downstream side of the folding device B connected to the image forming device A and is configured to receive the sheet S (that has been subjected to folding processing or has not been subjected thereto) from the folding device B and apply stapling processing and aligning processing as needed.

A post-processing path 26 is provided inside the post-processing device C, and post-processing units (not illustrated) such as a stapling unit and an aligning unit are disposed along the post-processing path 26. The post-processing device C receives the sheet S discharged from the image forming device A through the folding device B, applies, as needed, stapling processing and aligning processing to the received sheet S by the post-processing units such as the stapling unit and the aligning unit, and discharges the resultant sheet S to the storage tray 27 for storage.

[Folding Device]

The folding device B connected to the image forming device A is configured to receive the image-formed sheet S discharged from the sheet discharge port 16 of the image forming device A and apply folding processing to the sheet S.

Figure 2:
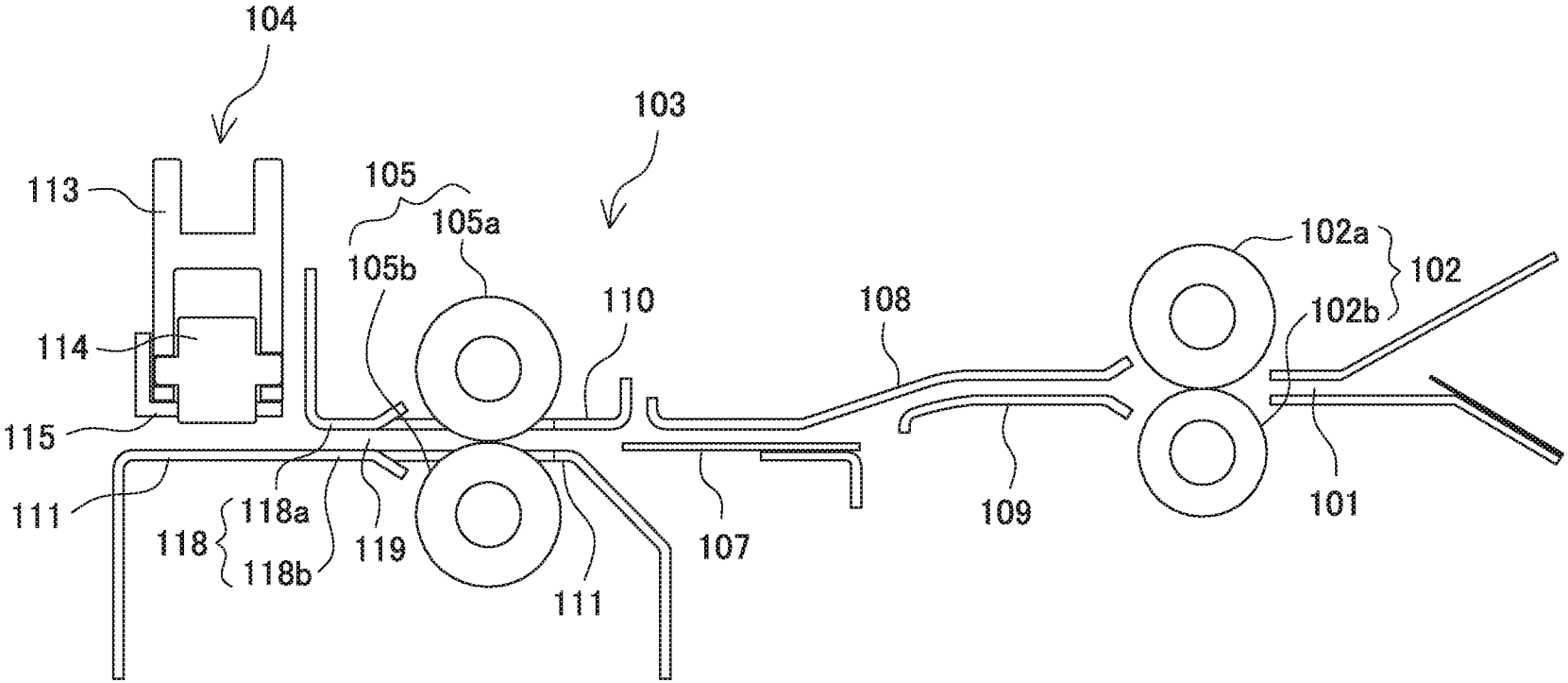
FIG. 2 is an explanatory view of a principal part of the folding processing mechanism and the additional folding unit of the folding processing device shown in FIG. 1.

FIG. 2 shows the internal structure of the sheet folding processing device B. A conveyance route 101 that substantially extends in a horizontal direction is arranged in the inside of the sheet folding processing device B. A conveyance roller pair 102 or a plurality of conveyance roller pairs 102 and a folding processing mechanism 103, or a sheet folding processing section, which is placed on the downstream side of the conveyance roller pair 102, are arranged on the conveyance route 101. Additionally, an additional folding unit 104 is arranged at the terminal end part of the conveyance route 101 and hence on the downstream side of the folding processing mechanism 103. The sheet folding processing device B executes a folding process on the sheet S that is being conveyed along the conveyance route 101 by means of the folding processing mechanism 103 and subsequently executes an additional folding process by means of the additional folding unit 104. The sheet folding processing device B then can deliver the sheet S that has been subjected to a folding process by the folding processing mechanism 103 and an additional folding process by the additional processing unit 104 to the post-processing device C.

As illustrated in FIG. 1, the conveying path 101 is disposed so as to be connected to the sheet discharge port 16 of the image forming device A, whereby the sheet S discharged from the sheet discharge port 16 can be carried in the folding device B through the conveying path 101. A discharge port of the additional folding unit 104 is also connected to the post-processing path 26 of the post-processing device C, whereby the sheet S discharged from the additional folding unit 104 can be carried in the post-processing device C through the post-processing path 26.

The conveying roller pair 102 is formed of a rubber roller and includes an upper conveying roller 102*a* disposed on the upper side and a lower conveying roller 102*b* disposed on the lower side so as to be opposed to the upper conveying roller 102*a*. In the present embodiment, the upper conveying roller 102*a* is connected to a not-shown conveying roller drive motor, so as to be rotated with the rotation of the conveying roller drive motor. On the other hand, the lower conveying roller 102*b* is brought into press-contact with the upper conveying roller 102*a* by biasing force of a not-shown spring, so as to follow the rotation of the upper conveying roller 102*a*. However, the conveying roller pair 102 is not limited to the above-described configuration and may have any appropriate configuration as long as it can convey the sheet S.

The folding mechanism 103 is constituted of a folding roller pair 105 and a push plate 107. The folding roller pair 105 is formed of a rubber roller and includes an upper folding roller 105*a* disposed on the upper side and a lower folding roller 105*b* disposed on the lower side so as to be opposed to the upper folding roller 105*a*. The lower folding roller 105*b* is brought into press-contact with the upper folding roller 105*a* by biasing force of a not-shown spring. The upper folding roller 105*a* and the lower folding roller 105*b* are connected in common to a not-shown folding roller drive motor and are rotated in the mutually opposite directions with the rotation of the folding roller drive motor. The push plate 107 is disposed between the conveying roller pair 102 and the folding roller pair 105 and is connected to a not-shown push plate drive motor. The push plate 107 is configured to be moved in parallel to the conveying path on the upstream side of the folding roller pair 105 with the driving of the push plate drive motor.

In the conveying path 101 between the conveying roller pair 102 and the folding roller pair 105, an upper conveying guide 108, a lower conveying guide 109, an upper folding guide 110 and a lower folding guide 111 are provided.

The upper conveying guide 108 is formed so as to extend from a location immediately downstream of the conveying roller pair 102 to a location above the push plate 107 so as to guide the leading end of the sheet S from the conveying roller pair 102 to the push plate 107. The upper conveying guide 108 regulates the direction of the flow of the sheet S conveyed in the conveying path 101. The upper conveying guide 108 is disposed above the conveying path 101 and has a shape bent downward toward the downstream side. The upper folding guide 110 is disposed between the upper conveying guide 108 and the folding roller pair 105 and extends to a location immediately upstream of the folding roller pair 105 so as to guide the leading end of the sheet S and a folded part (to be described later) of the sheet S to the folding roller pair 105. The upper folding guide 110 regulates the direction of the flow of the sheet S in the folding mechanism 103 and is disposed above the conveying path 101 on the downstream side of the upper conveying guide 108.

The lower conveying guide 109 regulates the direction of the flow of the sheet S conveyed in the conveying path 101. The lower conveying guide 109 is disposed below the conveying path 101 and has a shape bent downward toward the downstream side like the upper conveying guide 108. The lower conveying guide 109 is terminated in front of the push plate 107, so that a vacant space is formed on the downstream side of the lower conveying guide 109. The lower folding guide 111 is disposed downstream of the push plate 107 and extends over the upstream and downstream sides of the folding roller pair 105. A part of the lower folding guide 111 on the upstream side relative to the folding roller pair 105 has a horizontal surface for guiding the leading end of the conveyed sheet S and a folded part (to be described later) of the sheet S to a nip of the folding roller pair 105 and an inclined surface for easily guiding the leading end and the folded part of the sheet S to the horizontal surface.

Veneer 107 is arranged so as to be horizontally moved by means of a veneer drive unit and a control unit (not shown). Additionally, when the sheet S is conveyed by the conveyance roller pair 102 to folding roller pair 105 along the conveyance route 101, the veneer 107 is so placed as to fill the gap between lower conveyance guide 109 and lower folding guide 111 and guide the leading edge of the sheet S that is being conveyed to the lower folding guide 111. When the control unit recognizes that the sheet S is nipped by the folding roller pair 105 at the leading edge thereof, the control section moves the veneer 107 in a horizontal direction to the lower retreat position located below the lower conveyance guide 109 to cause a loop forming space to be produced between the lower conveyance guide 109 and the lower folding guide 111. After the loop forming space is produced and as the leading edge of the sheet S is conveyed by a predetermined distance in a state where the leading edge of the sheet S is nipped by the folding roller pair 105, an intermediate part of the sheet is warped downward in the loop forming space to produce a looped part. In this state, the veneer 107 is moved from the retreat position in a horizontal direction toward the folding roller pair 105 to produce a part to be folded and, after the veneer 107 gets to a position located in front of the folding roller pair 105, the first fold 132 is produced by driving the folding roller pair 105 and having the folding roller pair 105 convey the sheet S. Furthermore, the second fold 133 is produced by moving the veneer 107 to the retreat position, subsequently having the folding roller pair 105 convey the sheet S and nip the looped part of the sheet S. Then, the sheet S on which Z-fold has been produced is conveyed toward the downstream side.

Figure 3:
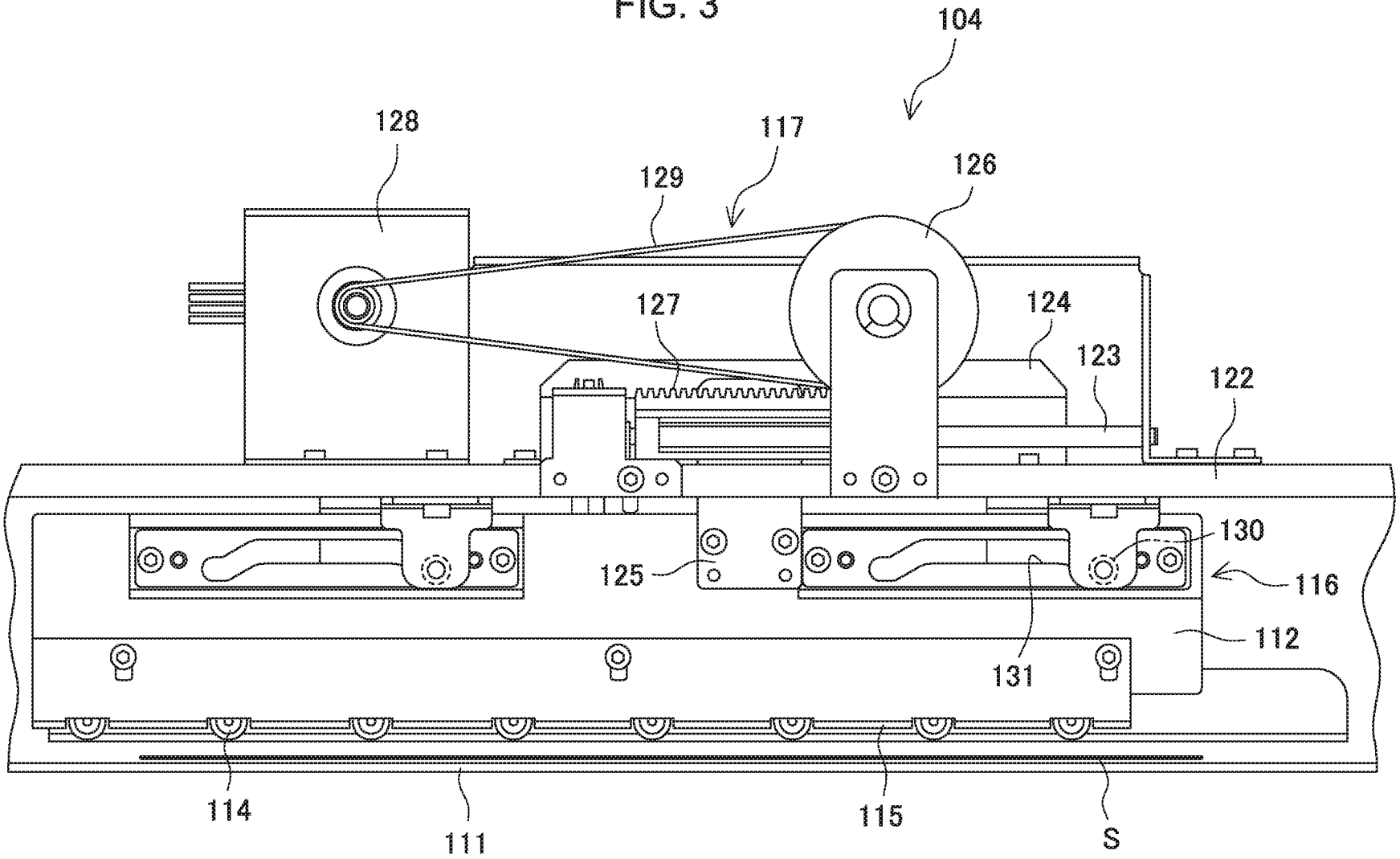
FIG. 3 is a view of the additional folding unit of the folding processing device shown in FIG. 1 as viewed from the discharging port side of the unit.

Now, the configuration of the additional folding unit 104 will be described below by referring to FIG. 3. The additional folding unit 104 is arranged above the lower folding guide 111 on the downstream side of the folding roller pair 105 as viewed in the conveyance direction of the sheet S. The additional folding unit 104 comprises a movable support member 112, a plurality of additional folding rollers 114 supported by the support member 112, restriction members 115 fitted to the support member 112, a first moving mechanism 116 for moving the support member 112 close to and away from the lower folding guide 111 and a second moving mechanism 117 for moving the support member 112 along the folds of the sheet S in a horizontal direction. A part of the upper folding guide 110 and a part of the lower folding guide 111 that are vertically arranged so as to face each other and located downstream relative to the folding roller pair 105 operate as a pair of carry-in guides 118 for leading the sheet S into the additional folding unit 104 and the upstream side ends of the pair of carry-in guides 118 serve as carry-in port 119. The plurality of additional folding rollers 114 supported by the support member 112 as described above and the lower folding guide 111 constitute an additional folding section.

The plurality of additional folding rollers 114 are arranged at regular intervals in a row that extends in the direction of the folds of the sheet S within the press members arranging region and supported by the support member 112 such that each of them is rotatable around the axis of rotation thereof that extends in the conveyance direction of the sheet S (in the direction parallel relative to the upper surface of the lower folding guide 111 and perpendicular relative to the folds of the sheet S). Because the axis of rotation of each of the additional folding rollers 114 extends in the conveyance direction of the sheet S and each of the additional folding rollers 114 is supported by the support member 112, the width of each of the additional folding rollers 114 is only required to ride on the folds of the sheet S in the conveyance direction so that the width of the sheet S as viewed in the conveyance direction thereof can be made small regardless of the diameter of the additional folding rollers 114. Therefore, the additional folding rollers 114 can be arranged in the vicinity of the folding roller pair 105 and consequently the folding processing device B can be downsized.

The first moving mechanism 116 moves the support member 112 that support the plurality of additional folding rollers 114 in the direction of bringing the support member 112 close to and away from the lower folding guide 111. Thus, the first moving mechanism 116 moves the plurality of additional folding rollers 114 so as to bring them close to and away from the lower folding guide 111 and hence can move the folds of the sheet S a, which are arranged between the additional folding rollers 114 and the lower folding guide 114, between the press position where the folds are pressed between the additional folding rollers 114 and the lower folding guide 111 and the retreat position to which the additional folding rollers 114 are to be moved from the press position in the direction of moving away from the sheet S. Additionally, the second moving mechanism 117 can move the plurality of additional folding rollers 114 along the folds of the sheet S by moving the support member 112 in horizontal directions (from left to right and vice versa in FIG. 3) at the press position. Note that the plurality of additional folding rollers 114 and the lower folding guide 111 do not directly contact each other even if the sheet S is not interposed between them at the press position. The length of the press members arranging region (namely the distance between the two additional folding rollers 114 arranged at the respective extreme end positions of the press members arranging region) is so determined that, when the additional folding rollers 114 are moved from the retreat position to the press position, one of the opposite ends of the folds of the sheet S (the upstream side end as viewed in the moving direction of the additional folding rollers 114) is located between the two additional folding rollers 114 arranged side by side at the corresponding extreme end position and the additional folding roller 114 arranged at the other extreme end position is located on the folds. Preferably, the length of the press members arranging region, namely the distance between the additional folding rollers 114 arranged at the respective extreme end positions of the press members arranging region, is equal to the length of the folds of the sheet S brought into the additional folding unit 104 less the arrangement pitch of the plurality of additional folding rollers 114 (the interval between any two additional folding rollers arranged side by side) as in the instance of the embodiment shown in the drawings. With such an arrangement, the number of the necessary additional folding rollers 114 can be reduced so that the cost of the additional folding rollers 114 can also be reduced. Then, because the number of additional folding rollers 114 that are supported by the support member 112 is reduced, if the force applied to the support member 112 is unchanged, the pressing force applied to the folds by each of the additional folding rollers 114 is increased to improve the effect of the additional folding operation. In other words, an additional folding operation can efficiently be executed with reduced force.

In the additional folding unit 104, after the sheet S is received in the additional folding unit 104 in a state where the plurality of additional folding rollers 114 are arranged at the retreat position or at a receiving position, which is also separated from the press position relative to the lower folding guide 111 toward the retreat position side, the position of the sheet S is detected by sheet position detecting means (not shown) arranged on the upstream side relative to the folding roller pair 105 and, when the folds of the sheet S get to a position located below the additional folding rollers 114, the sheet S is stopped and the plurality of additional folding rollers 114 are moved relative to the lower folding guide 111 by the first moving mechanism 116 so as to get to the press position. When the plurality of additional folding rollers 114 are moved to the press position, the sheet S is brought into the additional folding unit 104 such that one of the opposite ends (the upstream side end as viewed in the moving direction running along the folds) of the folds of the sheet S is located between the two additional folding rollers 114 that are disposed at one of the extreme end positions of the press members arranging region, while the other end of the folds (the downstream side ends as viewed in the moving direction running along the folds) is located outside the press members arranging region (namely, outside the additional folding roller 114 at the other extreme end position of the press members arranging region). Then, additionally, as the plurality of additional folding rollers 114 are moved at the press position along the folds of the sheet S relative to the lower folding guide 111 by means of the second moving mechanism 117, the additional folding rollers 114 execute an additional folding operation by pressing the folds of the sheet S over the entire range of the folds to strengthen the folds. Thus, each of the additional folding rollers 114 and the lower folding guide 111 operate as folding members in the above-described manner.

Additionally, the restriction members 115, which show a substantially L-shaped cross section and are fitted to the support member 111, are so arranged as to be found outside the additional folding rollers 114 at the extreme end positions and also between any two adjacently located additional folding rollers 114. In an additional folding process, in which the additional folding rollers 114 are moved relative to the lower folding guide 111 and along the folds of the sheet S in order to additionally fold the folds at the press position, the restriction members 115 are placed at respective restricting positions such that the distance d1 between the bottom surface (namely the surface facing the lower folding guide 111) of each of the restriction members and the top surface of the lower folding guide 111 becomes shorter than the height of the ordinary conveyance route, which may, for example, be the distance d2 between the pair of carry-in guides 118 (the upper carry-in guide 118*a* and the lower carry-in guide 118*b*) that define the carry-in route immediately following the carry-in port 119 of the additional folding unit 104. Then, the restriction members 115 are moved along the folds of the sheet S with the support member 112, while keeping the distance d1 unchanged. Note that the distance d1 between the bottom surface of each of the restriction members 115 and the top surface of the lower folding guide 111 is so determined as to prevent the restriction members and the lower folding guide 111 from directly contacting each other. With the above-described arrangement, prior to a press operation of the additional folding rollers 114 for an additional folding process, the restriction members 115 press down the folds to make the height of the folds smaller than the distance between the upper carry-in guide 118*a* and the lower carry-in guide 118*b* and thereafter the additional folding rollers 114 press the folds of the sheet S in the above-described state for the additional folding process.

Note that the gap between the plurality of additional folding rollers 114 and the lower folding guide 111 and the gap between the restriction members 115 and the lower folding guide 111 are held to respective constant values over the entire range of the folds of the sheet S in the extending direction of the folds.

Figure 4:
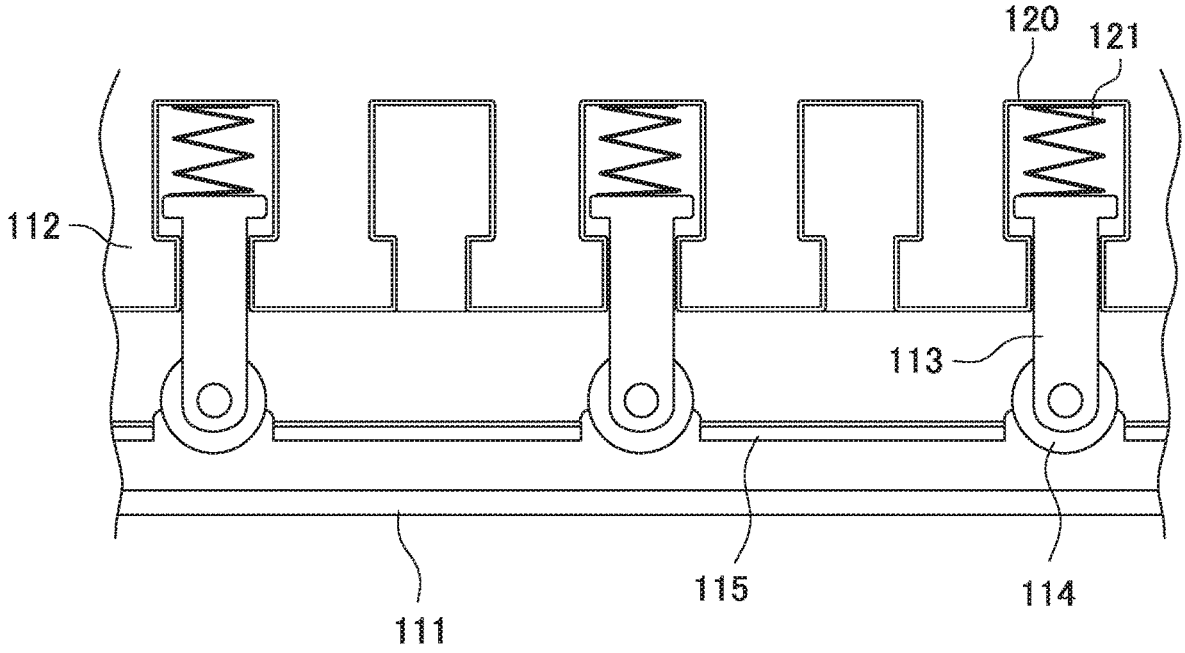
FIG. 4 is an explanatory view of the mechanism arranged in the additional folding unit to urge the additional folding rollers toward the sheet.

Preferably, each of the plurality of additional folding rollers 114 is rotatably fitted to an auxiliary member 113 that is supported by and movable relative to the support member 112 and a spring 121 is arranged between a spring receiving section 120 and the upper end of the auxiliary member 113 to urge the additional folding rollers 114 toward the lower folding guide 111 as shown in FIG. 4. With such an arrangement, when the support member 112 of the additional folding unit 104 and the restriction members 115 fitted to the support member 112 are moved downward toward the lower folding guide 111, the additional folding rollers 114 stop the downward movement once they contact the lower folding guide 111 by way of the sheet S but the support member 112 and the restriction members 115 can continue the downward movement further by the urging force of the contracted springs so that the downward movement of the support member 112 and the restriction members 115 can be stopped only when the distance between the bottom surfaces of the restriction members 115 and the top surface of the lower folding guide 111 comes to show a desired value and the restriction members 115 gets to the respective restricting position. Additionally, so long as the auxiliary members 113 are urged by the respective corresponding springs 121, each of the additional folding rollers 114 can apply predetermined pressing force to the folds of the sheet S even when the support member 112 is slightly inclined for its operation of moving along the folds of the sheet S so that the risk that the applied pressing force fluctuates on the folds to make the additional folding operation ununiform can be minimized.

Now, the configuration of the first moving mechanism 116 and that of the second moving mechanism 117 of the embodiment shown in the drawings will be described in greater detail below.

The support member 112 of the additional folding unit 112 is vertically movably fitted to a slider 124 by way of a bracket 125, which slider 124 is movable along a guide rail 123 rigidly fitted to the cabinet 122 or the like of the sheet folding processing device B, so as to be interlocked with the slider 124 to move in a horizontal direction. A rack 127 that is engaged with a pinion (not shown) and rotates integrally with a pulley 126 is arranged on the slider 124 such that the slider 124 can be moved in a horizontal direction along the guide rail 123 by driving the additional folding drive motor 128, transmitting its rotations to the pulley 126 by way of the belt 129 and thereby rotating the pulley 126.

Additionally, cam grooves 131 are formed on the support member 112 and engaged with respective contacts 130 that are rigidly fitted to the cabinet 122 or the like of the sheet folding processing device B. As the support member 11 moves horizontally, the cam grooves 131 that are engaged with the respective contacts 130 are moved with the support member 112. In other words, when the support member 112 moves, it is guided to follow the profile of the cam grooves 131. Each of the cam grooves 131 includes a first bottom horizontal part that extends in a substantially horizontal direction, a first inclined part upwardly and inclinedly extending from the terminal end of the first bottom horizontal part, a top horizontal part extending from the terminal end of the first inclined part in a substantially horizontal direction, a second inclined part downwardly and inclinedly extending from the terminal end of the top horizontal part and a second bottom horizontal part extending substantially horizontally from the terminal end of the second inclined part. As the support member 112 is moved relative to the cabinet 122 by the slider 124 in a horizontal direction as shown in FIG. 3, while the first inclined part or the second inclined part of each of the cam grooves 131 is held in engagement with the corresponding contact 130, the support member 112 is moved in a vertical direction as shown in FIG. 3 and hence in a direction in which the support member 112 moves away from the lower folding guide 111 or in a direction in which the support member 112 comes closer to the lower folding guide 111, whichever appropriate. Thus, the first moving mechanism 116 is formed by the guide rail 123, the slider 124, the bracket 125, the pulley 126, the rack 127, the additional folding drive motor 128, the belt 129, the contacts 130, the first inclined parts of the cam grooves 131 and the second inclined parts of the cam grooves 131. Additionally, as the support member 112 is moved relative to the cabinet 122 in a horizontal direction by means of the slider 124, while the top horizontal part of each of the cam grooves 131 is held in engagement with the corresponding contact 130, the support member 112 and the plurality of additional folding rollers 114 that are supported by the support member 112 are moved in a horizontal direction as shown in FIG. 3 along the folds of the sheet S relative to the lower folding guide 111. Thus, the second moving mechanism 117 is formed by the guide rail 123, the slider 124, the bracket 125, the pulley 126, the rack 127, the additional folding drive motor 128, the belt 129, the contacts 130 and the top horizontal parts of the cam grooves 131. In the embodiment illustrated in the drawings, the contacts 130 are rigidly fitted to the cabinet 122 or the like and the cam grooves 131 are formed on the support member 112. It may be needless to say that alternatively the contacts 130 may be rigidly fitted to the support member 112 and the cam grooves 131 may be formed on the cabinet 122.

Note that, when the plurality of additional folding rollers 114 are arranged at regular intervals as in the embodiment illustrated in the drawings, the plurality of additional folding rollers 114 need to be moved along the folds relative to the lower folding guide 111 at the press position by a distance not less than the interval between two neighboring additional folding rollers 114 (namely the arrangement pitch of the additional folding rollers 114) in order to press all the folds, which are located between two neighboring additional folding rollers 114, between the additional folding rollers 114 and the lower folding guide 111. With the above-described configuration of the first moving mechanism 116, the plurality of additional folding rollers 114 that are supported by the support member 112 are brought closer to the lower folding guide 111 and moved to the press position by moving the slider 124 in a horizontal direction, while each of the contacts 130 is held in engagement with the first inclined part of the corresponding cam groove 131. On the other hand, with the above-described configuration of the second moving mechanism 117, the plurality of additional folding rollers 114 that are supported by the support member 112 are moved along the folds at the press position by moving the slider 124 in a horizontal direction, while each of the contacts 130 is held in engagement with the top horizontal part of the corresponding cam groove 131. Therefore, the length of the top horizontal part of each of the cam grooves 131 in the horizontal direction (that is running along the folds) is made greater than the arrangement pitch of the additional folding rollers 114.

Now, the operation of the additional folding unit 104 of the embodiment illustrated in the drawings will be described in greater detail by referring to FIGS. 5 to 8. Note that, in the following description, it is assumed that a sheet S, on which a Z-fold forming process has been executed by the folding processing mechanism 103 to produce the first fold 132 and the second fold 133, is carried into the additional folding unit 104.

Figure 5A:
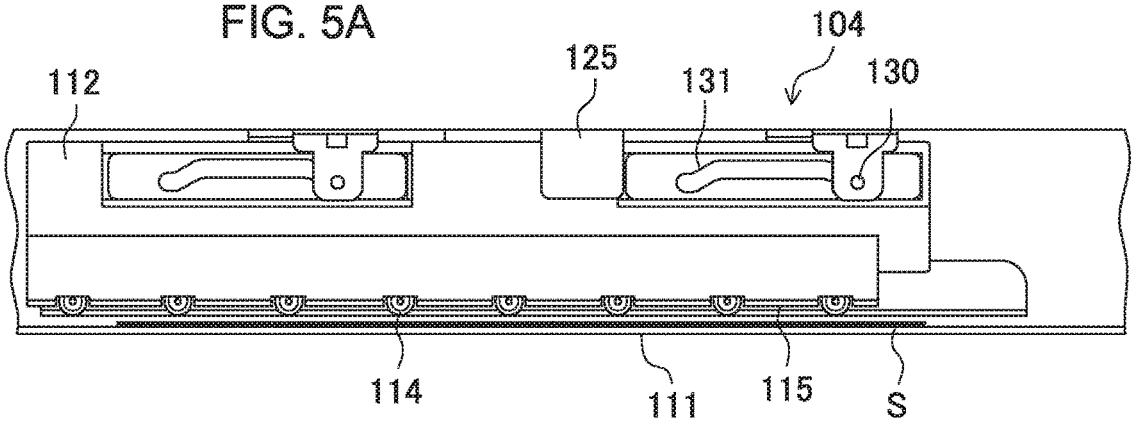
Figure 7A:
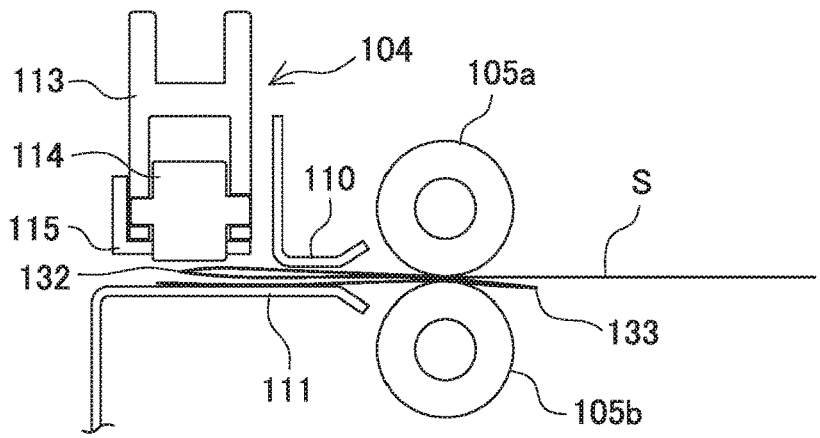
FIGS. 7A to 7D are an explanatory graphic illustration of the operation of the additional folding section of executing an additional folding process on a sheet in the additional folding unit, in which FIG. 7A to FIG. 7D respectively show the states same as those shown in FIGS. 5A to 5D but the additional folding section is viewed from a lateral side thereof.

When the sheet S is received into the additional folding unit 104 from the folding processing mechanism 103 by way of the carry-in port and the carry-in route formed by the upper carry-in guide 118*a* and the lower carry-in guide 118*b*, the plurality of additional folding rollers 114 that are supported by the support member 112 are placed at the receiving position, which is the home position, as shown in FIG. 5A and FIG. 7A. At this time, the lower ends of the plurality of additional folding rollers 114 that are supported by the support member 112 define the top side of the carry-in route while the lower folding guide 111 defines the bottom side of the carry-in route so that they operate as guide for leading the first fold 132 of the sheet S, which is being carried in, into between the additional folding rollers 114 and the lower folding guide 111. Additionally, at this time, each of the contacts 130 is located at one of the opposite ends of the first bottom horizontal part of the corresponding cam groove 131. Note that, in the embodiment illustrated in the drawings, the second retreat position that will be described hereinafter is the receiving position. However, if the additional folding rollers 114 are located on the side of the retreat position (the first retreat position or the second retreat position) rather than on the side of the press position and the additional folding rollers 114 are separated from the lower folding guide 111, a position different from the second retreat position may be selected for the receiving position.

Figure 5B:
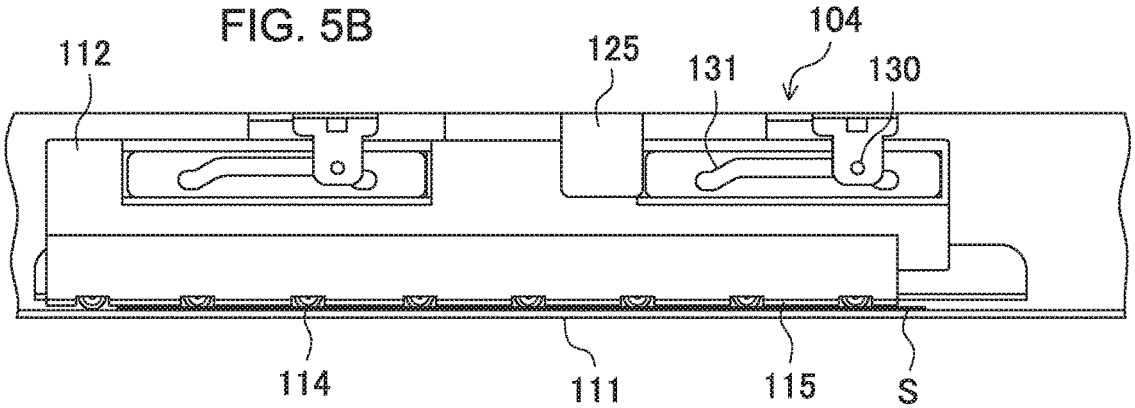
Figure 7B:
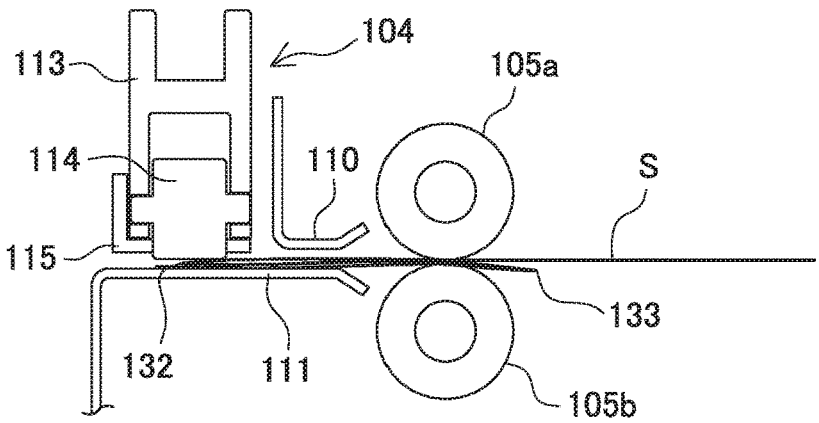

As the sheet position detection means (not shown) arranged on the upstream side of the folding roller pair 105 detects the position of the sheet S and recognizes that the first fold 132 on the leading edge side of the sheet S, which has been carried into the carry-in port 119 from the folding roller pair 105 as viewed in the carry-in direction, gets to below the additional folding rollers 114 as shown in FIG. 7A, the operation of conveying the sheet S is suspended and the additional folding drive motor 128 is driven to move the support member 112 in a horizontal direction along with the slider 124 by way of the pinion, which integrally rotates with the pulley 126, and the rack 127. Then, as a result, the position of each of the contacts 130 at which the contact 130 is engaged with the corresponding cam groove 131 is moved from the first bottom horizontal part to the first inclined part. Then, accordingly, the support member 112 is moved downward toward the lower folding guide 111 and the plurality of additional folding rollers 114 that are supported by the support member 112 move to the press position where the plurality of additional folding rollers 114 that are support by the support member 112 pinch the first fold 132 of the sheet S between themselves and the lower folding guide 111 and press the first fold 132 as shown in FIG. 5B and FIG. 7B. At this time, the sheet S is brought into a state where one of the opposite ends of the first fold of the sheet S (the upstream side end as viewed in the moving direction of the additional folding rollers 114 on the outbound path) is located between two neighboring additional folding rollers 114 that are arranged at one of the extreme end positions and the additional folding roller 114 that is located on the other extreme end position rides on the first fold 132 of the sheet S so that the other end of the first fold 132 of the sheet S (the downstream side end as viewed in the moving direction of the additional folding rollers 114 on the outbound path) is located outside the press members arranging region (see FIG. 5B). While FIG. 5B and FIG. 7B show that one of the opposite ends of the first fold 132 of the sheet S is located at an intermediate position between the two neighboring additional folding rollers 114 that are arranged at the extreme end position, the position where the press point of the additional folding rollers 114 arranged at the extreme end position agrees with one of the opposite ends of the first fold 132 of the sheet S is also defined to be "between the two neighboring additional folding rollers 114 that are arranged at the extreme end position". Additionally, the auxiliary members 113 to which the additional folding rollers 114 are respectively fitted are urged toward the lower folding guide 111 by the respective springs 121 and therefore, even after the support member 112 is moved downward and the additional folding rollers 114 come to contact the lower folding guide 111 by way of the sheet S, the support member 112 can further be moved downward. Then, accordingly, the restriction members 115 are also moved further downward to press the first fold 132 of the sheet S that is located under the additional folding rollers 114 to limit the thickness of the first fold 132 of the sheet S so as not to become greater than a predetermined thickness. The expression of carry-in direction as used in this specification refers to the direction in which the sheet S is brought into the additional folding unit 104 from the folding roller pair 105 by way of the carry-in port 119.

Figure 5C:
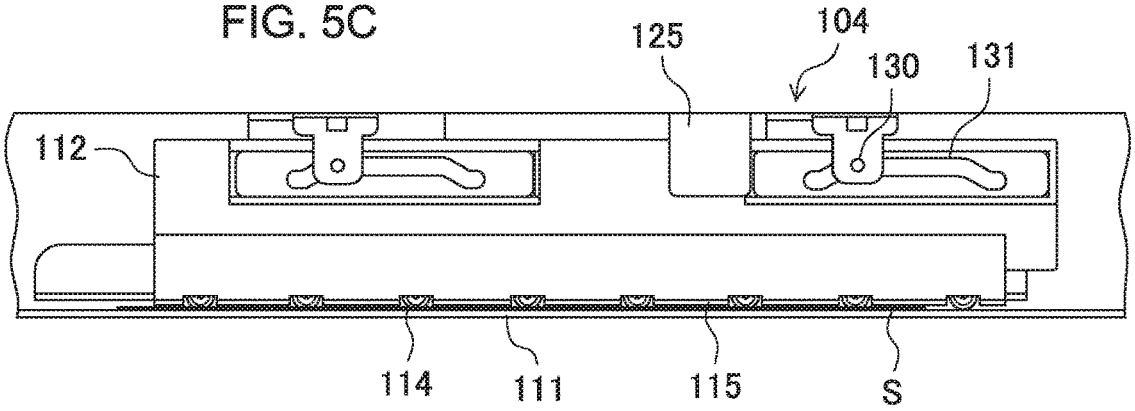
Figure 7C:
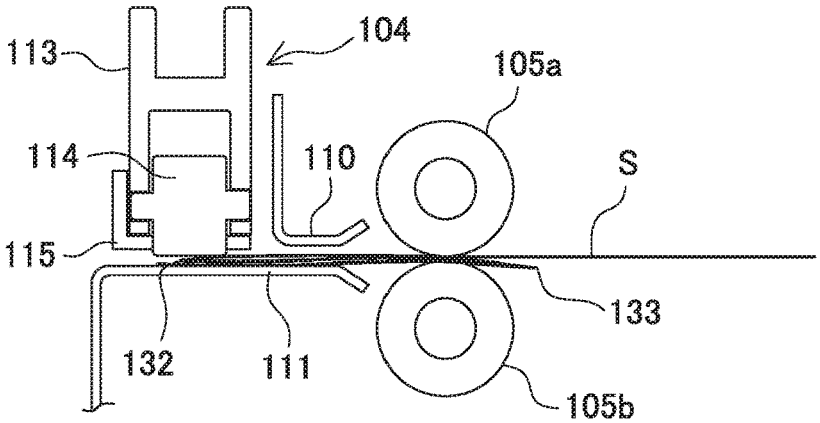

As the support member 112 is moved further in the horizontal direction along with the slider 124 by driving the additional folding drive motor 128 so as to move away from the state shown in FIG. 5B and FIG. 7B, each of the spots where the contacts 130 are held in engagement with the respective cam grooves 131 moves from the first inclined part to the top horizontal part as shown in FIG. 5C and FIG. 7C. Then, the plurality of additional folding rollers 114 that are supported by the support member 112 are moved at the press position relative to the lower folding guide 111 along the first fold 132 of the sheet S by a distance not less than the arrangement pitch of the additional folding rollers 114 until the leading additional folding roller 114 as viewed in the moving direction rides over the other end of the first fold 132 of the sheet S (the downstream side end in the moving direction of the additional folding rollers 114 on the outbound path), while the restriction members 115 that are fitted to the support member 112 are limiting the thickness of the first fold 132 of the sheet S so as not to be greater than the predetermined thickness (which is equal to distance d1). In greater detail, a state where the other end of the first fold 132 of the sheet S is located between the two neighboring additional folding rollers 114 that are found at the other extreme end position and the additional folding roller 114 located at the former extreme end position is riding on the first fold 132 of the sheet S arises so that the former end of the first fold 132 of the sheet S (the upstream side end in the moving direction of the additional folding rollers 114 on the outbound path) is located outside the press member arranging region (see FIG. 5C). While the other end of the first fold 132 of the sheet S is located at an intermediate position between the two neighboring additional folding rollers 114 that are found at the extreme end position in FIG. 5C and FIG. 7C, the position where press point of the additional folding roller 114 located at the extreme end position agrees with the other end of the first fold 132 of the sheet S is also defined to be "between the two neighboring additional folding rollers 114 that are found at the extreme end position". In this way, the first fold 132 is pressed over the entire range thereof by the additional folding rollers 114 and the lower folding guide 111 for additional folding in order to strengthen the first fold 132.

As the support member 112 is moved further in the horizontal direction along with the slider 124 to move away from the state shown in FIG. 5C and FIG. 7C by driving the additional folding drive motor 128, each of the spots where the contacts 130 are held in engagement with the respective cam grooves 131 is moved from the top horizontal part to the second bottom horizontal part by way of the second inclined part. Then, as a result, the support member 112 is raised with the restriction members 115 to move away from the lower folding guide 111 so as to come closer to the position where the plurality of additional folding rollers 114 supported by the support member 112 have finished the pressing operation and moved to the first retreat position located above to complete the first additional folding process. Note that the first retreat position differs from the receiving position, which is the home position.

Figure 5D:
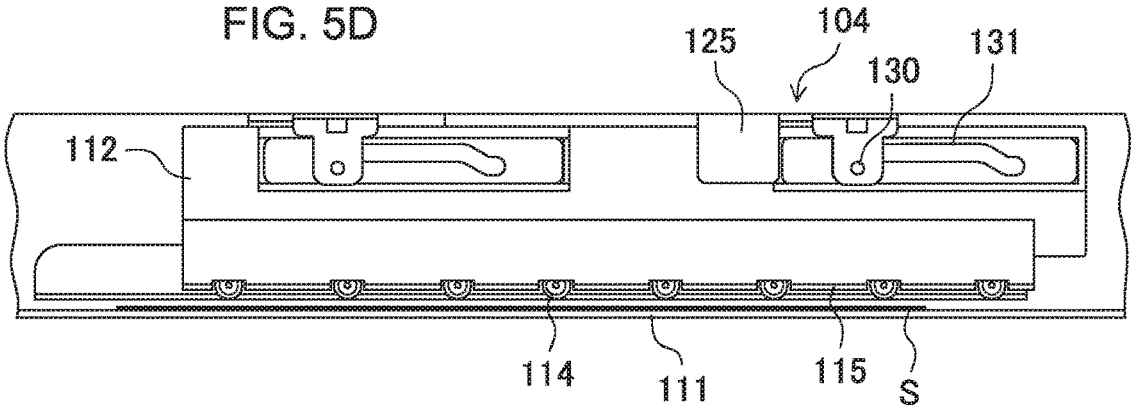
Figure 7D:
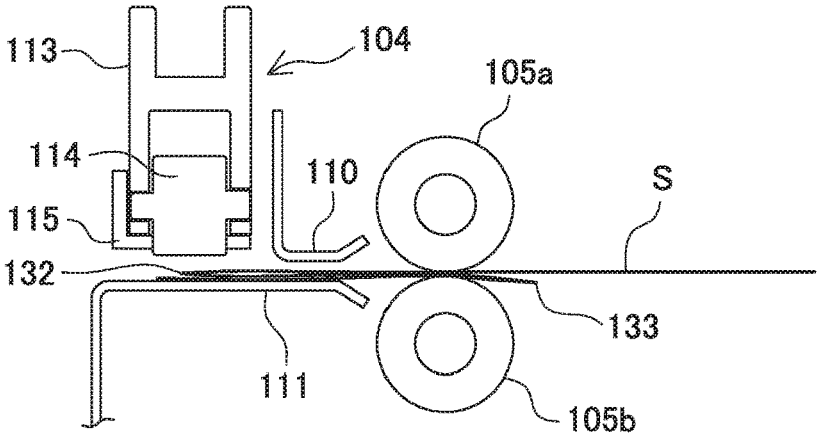

As the first additional folding process is completed and the state as shown in FIG. 5D and FIG. 7D arises, the sheet S becomes ready to be conveyed away by the conveyance roller pair 102 located on the upstream side as viewed in the carry-in direction and the folding roller pair 105. Then, the sheet S is conveyed away by the conveyance roller pair 102 and the folding roller pair 105 to leave the state shown in FIG. 5D and FIG. 7D. As the sheet position detecting means arranged on the upstream side of the folding roller pair 105 detects the position of the sheet S and recognizes that the second fold 133 once located on the rear end side relative to the first fold 132 as viewed in the carry-in direction has got to below the additional folding rollers 114 as shown in in FIG. 8E, the operation of conveying the sheet S is suspended.

Figure 6E:
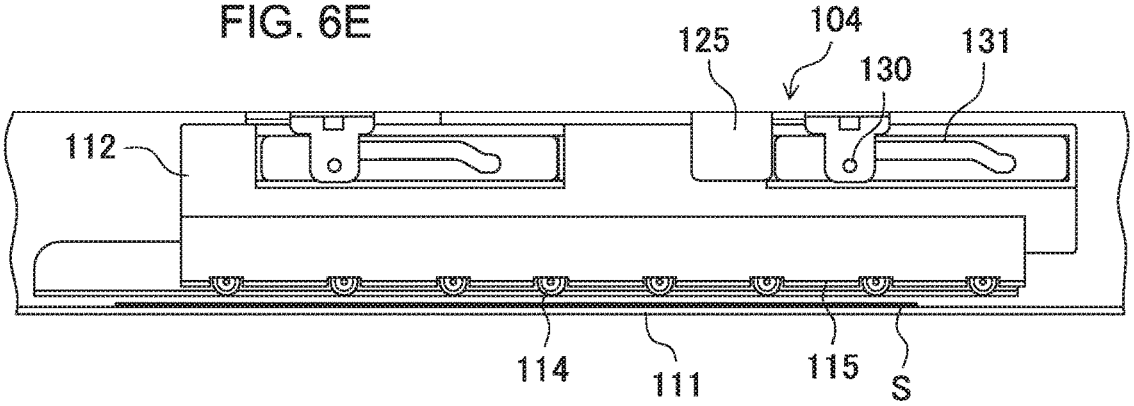
Figure 6F:
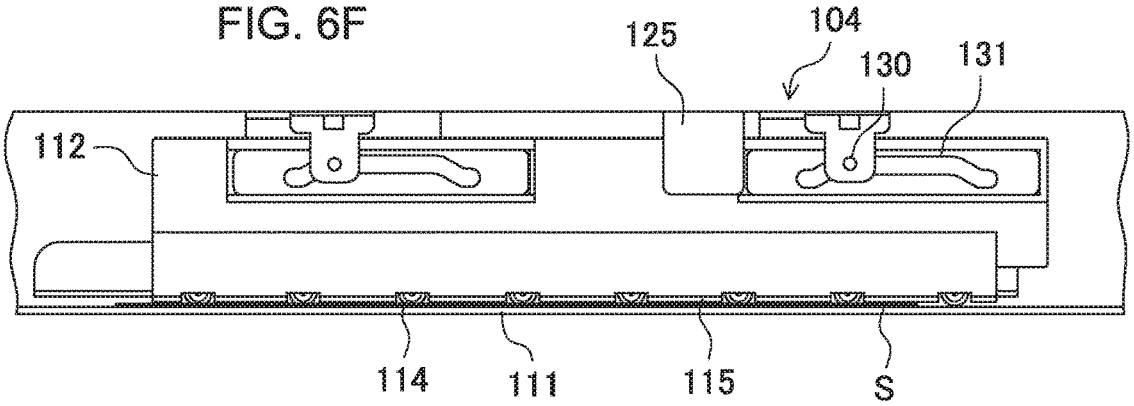
Figure 8E:
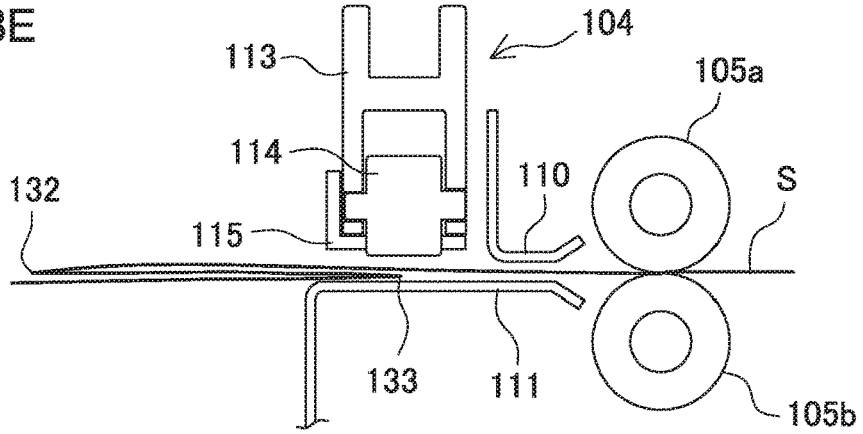
FIGS. 8E to 8H are an explanatory graphic illustration of the operation of the additional folding section of executing an additional folding process on a sheet in the additional folding unit, in which FIGS. 8E to 8H respectively show the states same as those shown in FIGS. 6E to 6H but the additional folding section is viewed from a lateral side thereof.
Figure 8F:
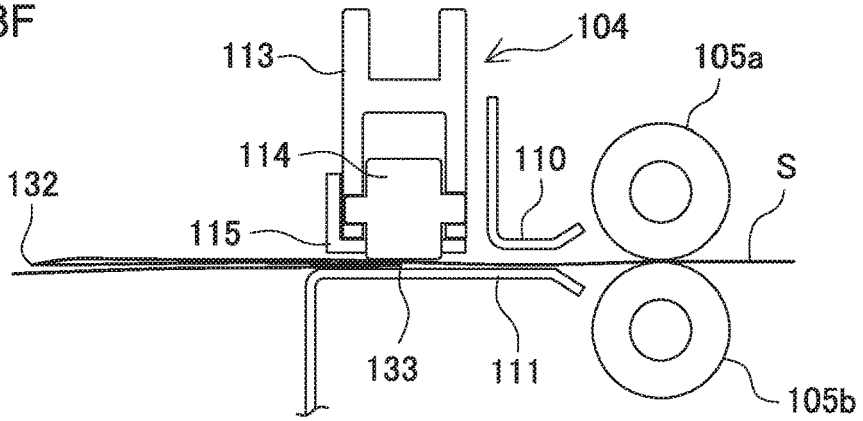

As the second fold 133 of the sheet S is stopped below the additional folding rollers 114 as shown in FIG. 8E, the support member 112 is moved in the horizontal direction that is opposite to the direction in which the support member 112 is moved on the outbound path along with the slider 124 by way of the pinion, which rotates integrally with the pulley 126, and the rack 127 by driving the additional folding drive motor 128 in the direction opposite to the direction in which the additional folding drive motor 128 is driven on the outbound path. As a result, each of the spots where the contacts 130 are held in engagement with the respective cam grooves 131 is moved from the second bottom horizontal part to the second inclined part. Then, accordingly, the support member 112 is moved downward toward the lower folding guide 111 and, as shown in FIGS. 6F and 8F, the plurality of additional folding rollers 114 that are supported by the support member 112 are moved to the press position where the plurality of additional folding rollers 114 and the lower folding guide 111 pinch the second fold 133 between them and presses the second fold of the sheet S. The position of the plurality of additional folding rollers 114 at this time, namely the position of the start point on the inbound path, is same as the position of the end point on the outbound path. Furthermore, at this time, a state where one of the opposite ends of the second fold 133 of the sheet S (the upstream side end as viewed in the moving direction of the additional folding rollers 114 on the inbound path) is located between the two neighboring additional folding rollers that are arranged at one of the extreme ends and the additional folding roller 114 that is arranged at the other extreme end rides on the second fold 133 of the sheet S arises so that the other end of the second fold 133 of the sheet S (the downstream side end as viewed in the moving direction of the additional folding rollers 114 on the inbound path) is located outside the press member arranging region (see FIG. 6F). Additionally, since the auxiliary members 113 to which the additional folding rollers 114 are respectively fitted are urged toward the lower folding guide 111 by the respective springs 121, the support member 112 is moved downward and, after the support member 112 is moved downward and the additional folding rollers 114 contact the lower folding guide 111 by way of the sheet S, the support member 112 can be moved further downward. Then, accordingly, the restriction members 115 are also moved further downward to press the parts of the sheet S that are located under the respective additional folding rollers 114 and the second fold 132 of the sheet S and limit the thickness of the second fold 132 of the sheet S so as not to be greater than the predetermined thickness.

As the support member 112 is moved further with the slider 124 in the horizontal direction that is opposite to the moving direction of the support member 112 on the outbound path by driving the additional folding drive motor 128 to move away from the state shown in FIG. 6F and FIG. 8F, each of the spots where the contacts are held in engagement with the respective cam grooves 131 is moved from the second inclined part to the top horizontal part. Then, the plurality of additional folding rollers 114 that are supported by the support member 112 are moved at the press position relative to the lower folding guide along the second fold 133 of the sheet S by a distance not less than the arrangement pitch of the plurality of additional folding rollers 114 in the direction opposite to the moving direction of the additional folding rollers 114 on the outbound path until the leading additional folding roller 114 as viewed in the moving direction rides over the end of the second fold 133 of the sheet S, while the restriction members 115 fitted to the support member 112 are limiting the thickness of the second fold 133 of the sheet S so as not to be greater than the predetermined thickness (equal to the distance d1). In this way, the second fold 133 is pressed over the entire range thereof by the additional folding rollers 114 and the lower folding guide 111 for additional folding in order to strengthen the second fold 133.

Figure 6G:
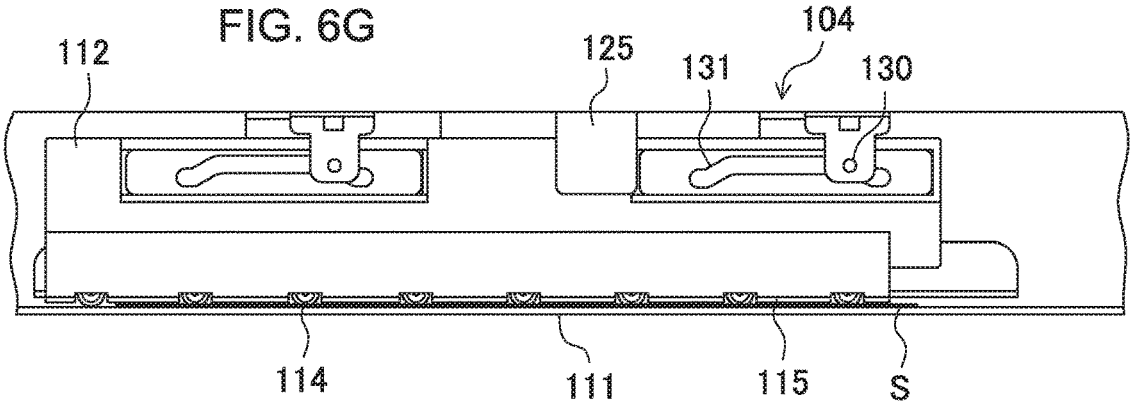
Figure 6H:
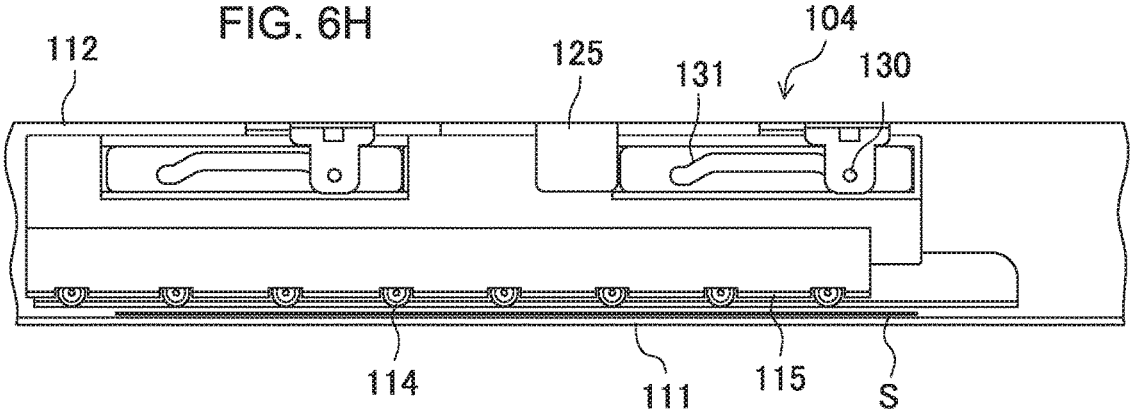
Figure 8G:
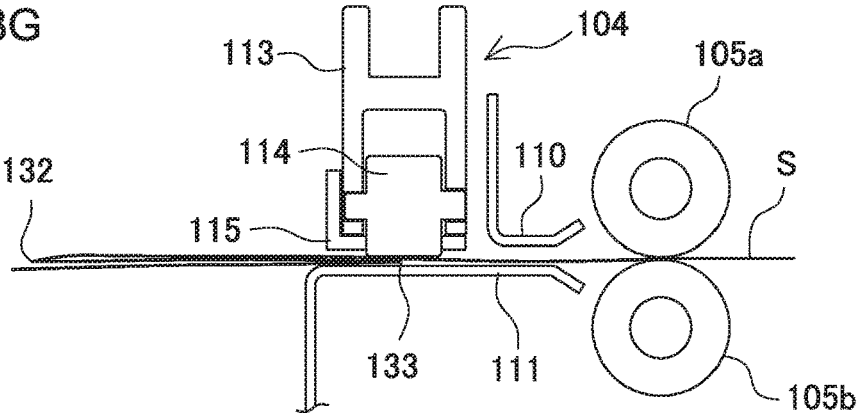
Figure 8H:
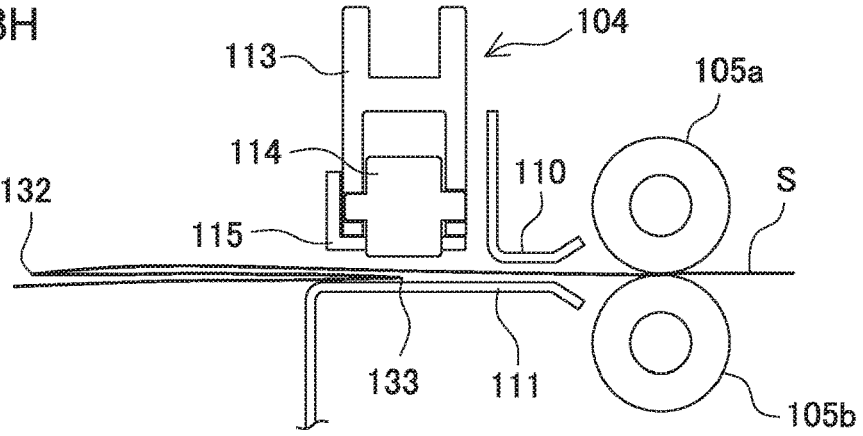

As the support member 112 is moved further with the slider 124 in the horizontal direction that is opposite to the moving direction of the support member 112 on the outbound path by driving the additional folding drive motor 128 to move away from the state shown in FIG. 6G and FIG. 8G, each of the spots where the contacts 130 are held in engagement with the respective cam grooves 131 is moved from the top horizontal part to the first horizontal part by way of the first inclined part. Then, as a result, the support member 112 is moved upward with the restriction members 115 in the direction of moving away from the lower folding guide 111 to the second retreat position located close to the position where the plurality of additional folding rollers 114 supported by the support member 112 finished the additional pressing operation to complete the second additional folding process. In this embodiment, the second retreat position is determined to be same as the receiving position that is the home position. However, it is possible to determine the second retreat position to be a position that is different from the receiving position.

After the completion of the series of additional pressing operations as described above, the sheet S is conveyed by the conveyance roller pair 102 located at an upstream position as viewed in the carry-in direction and the folding roller pair 105 toward the post-processing device C on the downstream side. Note that the lower ends of the plurality of additional folding rollers 114 that have been moved to the retreat position and the bottom surfaces of the restriction members 115 operate as so many guides when the sheet S that has been subjected to an additional folding process is discharged.

When the press members arranging region is made to cover the entire folds of the sheet S, there arises a need for securing a space that is enough to accommodate at least the part of the press members arranging region that is disposed outside the folds of the sheet S on the upstream side as viewed in the moving direction of the additional folding rollers 114 that is running along the folds and on the side of the folds of the sheet S and, at the same time, also for securing a space on the downstream side as viewed in the moving direction and on a lateral side of the folds of the sheet S that is at least enough to allow the movement along the folds of the sheet S of the support member 112 for pressing the folds in addition to the part of the press members arranging region disposed outside the folds of the sheet S. However, in the additional folding unit 104 of the sheet folding processing device B shown in the drawings, the initial position of the leading additional folding roller 114 that is moving toward the folds as viewed in the moving direction of the additional folding rollers 114 is located on the folds of the sheet S and hence the press members arranging region is not located outside the folds of the sheet S as viewed in the moving direction. Therefore, the additional folding unit 104 can be downsized to the extent of non-existence of the press members arranging region disposed outside the folds of the sheet S at the initial position of the additional folding rollers 114 for moving along the folds.

Besides, in the additional folding unit 104, when the additional folding rollers 114 are moved relative to the lower folding guide 111 from the retreat position or the receiving position to the press position by means of the first moving mechanism 116, one of the opposite ends of the folds of the sheet S (the upstream side end as viewed in the moving direction that is running along the folds) is located between the two neighboring additional folding rollers 114 at one of the extreme end positions of the press members arranging region and, at the same time, the other end of the folds (the downstream side end as viewed in the moving direction that is running along the folds) is located outside the press members arranging region (namely outside the additional folding roller 114 at the other extreme end position of the press members arranging region). On the other hand, when the plurality of additional folding rollers 114 are arranged at regular intervals as viewed in the moving direction that is running along the folds, the plurality of additional folding rollers 114 need to be moved along the folds by a distance not less than the interval between two neighboring additional folding rollers 114 (namely the arrangement pitch of the additional folding rollers 114) in order to press all the folds located between the two neighboring additional folding rollers by means of the additional folding rollers 114 and the lower folding guide 111. Therefore, the additional folding rollers 114 at the extreme end position on the upstream side as viewed in the moving direction that is running along the folds ride over the end of the sheet S on the upstream side as viewed in the moving direction to reliably get to the position of the additional folding roller 114 located next to the additional folding roller 114 disposed at the extreme end position on the upstream side as viewed in the moving direction that is running along the folds in the initial stage of the movement so that the end part of the sheet S located between the two additional folding rollers 114 at the extreme end position on the upstream side as viewed in the moving direction in the initial stage of the movement is pressed for additional folding by moving only the smallest number of additional folding rollers 114 required to execute the additional folding process and hence the support member 112 by a distance not less than the arrangement pitch of the additional folding rollers 114.

Besides, in the additional folding unit 104, the press members arranging region is preferably made shorter than the length of the folds of the sheet by the arrangement pitch of the plurality of additional folding rollers 114 such that, when the plurality of additional folding rollers 114 are moved relative to the lower folding guide 111 by the second moving mechanism 117 from the retreat position or the receiving position to the press position, one of the opposite ends of the folds of the sheet is located between the two neighboring additional folding rollers 114 at one of the extreme end positions of the press members arranging region. Therefore, when the additional folding roller 114 at the upstream side extreme end position as viewed in the moving direction that is running along the folds of the sheet S is arranged near the end of the folds of the sheet, the additional folding roller 114 located at the downstream side extreme end position as viewed in the moving direction that is running along the folds is moved to ride over the downstream side end of the sheet S as viewed in the moving direction by way of the part of the press members arranging region that is located outside the folds in the initial stage of the movement and hence the end part of the sheet S located on the downstream side of the press members arranging region as viewed in the moving direction can be pressed for additional folding by moving the additional folding rollers 114 along the folds only by a distance slightly greater than the arrangement pitch of the additional folding rollers 114. In other words, the folds of the sheet S can be additionally folded over the entire range of the folds of the sheet S by moving the smallest number of additional folding rollers 114 required to execute the additional folding process only by a distance slightly longer the arrangement pitch of the additional folding rollers 114. Then, the time necessary for the additional folding process can be minimized. Additionally, with such an arrangement, the space on a lateral side of the folds of the sheet S required to accommodate the press members arranging region and to allow the support member 112 to move can be reduced to a great extent. Then, the additional folding unit 104 can further be downsized.

Furthermore, in the additional folding unit 104, the plurality of additional folding rollers 114 are driven to move along the folds such that a single first fold is additionally folded on the outbound path and, if a plurality of folds have been produced on the single sheet S as in the instance of Z-fold or inner trifold, the second fold is additionally folded on the inbound path. In other words, an additional folding process can be executed on a plurality of folds on the outbound path and also on a plurality of folds that are different from the above folds on the inbound path. In other words, an additional folding process can efficiently be executed on a plurality of folds in a short period of time to minimize the additional time necessary for the additional folding process.

While an additional folding process by the additional folding unit 104 on a sheet S having Z-fold is described above, the additional folding unit 104 can accommodate a sheet having bi-fold, which is a sheet that is folded once, a sheet having four-fold, which is a sheet that is folded three times, or a sheet having more than four-fold. When a sheet has only a single fold, an additional folding process is executed on a preceding sheet on the outbound path and subsequently the preceding sheet is discharged. Then, the additional folding process is executed on the succeeding sheet on the inbound path. In this way, an additional folding process can efficiently be executed on continuously arranged sheets one after another in a short period of time. Furthermore, when a sheet has four-fold, which is a sheet that is folded three times, or more than four-fold, it may be so arranged that the operation of conveying the sheet is suspended each time when a fold is carried in below the additional folding rollers 114 and an additional folding process is executed by moving the plurality of additional folding rollers 114 along the fold either on the outbound path or on the inbound path. Additionally, a folding process may be executed either on a bundle of sheets or on a single sheet. Likewise, a folding process may be executed either on a bundle of sheets that has been subjected to a binding process or on a bundle of sheet that has not been subjected to a binding process.

Now, a positional arrangement of a folding roller pair 105 and a plurality of additional folding rollers 114 that is suitable for sheets having Z-fold will be described below.

As described above, a sheet S is received into the additional folding unit 104 in a state where the plurality of additional folding rollers 114 are arranged relative to the lower folding guide 111 at the retreat position (the first retreat position or the second retreat position) or at the receiving position located on the side of the retreat position rather than on the side of the press position. Then, the sheet S is stopped when the leading fold as viewed in the carry-in direction of the sheet gets to below the plurality of additional folding rollers 114 and, after the plurality of additional folding rollers 114 are brought close to the lower folding guide 111 and moved to the press position, the additional folding rollers 114 are moved along the folds of the sheet S. The sheet S on which Z-fold has been formed has the preceding first fold 132 located on the leading edge side of the sheet S as viewed in the conveyance direction of the sheet S and the succeeding second fold 133 located on the trailing edge side of the sheet S relative to the first fold as viewed in the conveyance direction of the sheet S as shown in FIG. 7 and FIG. 8. Thus, the sheet S has a sheet part where three layers of sheet have been produced by the Z-fold between the first fold 132 and the second fold 133. In the sheet folding processing device B, the folding roller pair 105 of the folding processing mechanism 103 and the plurality of additional folding rollers 114 show a positional relationship such that, when the first fold 132 gets to below the plurality of additional folding rollers 114, the sheet part where three layers of sheet have been produced by the Z-fold is held between the folding roller pairs 105. In other words, the folding roller pair 105 of the folding processing mechanism 103 and the plurality of additional folding rollers 114 are arranged with a positional relationship that a portion of the sheet part having the three layers of the sheet is pinched between the folding roller pair 105 (a positional relationship that the second fold 133 is located upstream relative to the folding roller pair 105 as viewed in the conveyance direction of the sheet S). When the distance between the folding roller pair 105 and the plurality of additional folding rollers 114 as viewed in the conveyance direction is greater than the length of the sheet part having the three layers produced by the Z-fold (the length between the first fold 132 and the second fold 133), nothing can hold the sheet part having the three layers and the sheet S to which a folding process has been executed by the folding roller pair 105 is unfolded due to the resilience of the sheet S on the conveyance route at the time when the second fold 133 passes through the folding roller pair 105. This phenomenon particularly remarkably appears when the sheet S has a large weight.

The folding roller pair 105 and the plurality of additional folding rollers 114 are to be arranged within a distance range shorter than the shortest distance between the first fold 132 and the second fold 133 as viewed in the conveyance direction of the sheet S with which the folding processing mechanism 103 can execute the folding process. With this arrangement, the plurality of additional folding rollers 114 can execute an additional folding process on the first fold 132 while the folding roller pair 105 keeps on holding the sheet part having the three layers between them. In other words, during the operation of additionally folding the first fold 132, the folding roller pair 105 operate as a pair of holding members for holding the sheet part having the three layers between them. With this arrangement, the plurality of additional folding rollers 114 can press the first fold 132 produced by the folding roller pair 105 without allowing any relative displacement to take place on the sheet part having the three layers so that an additional folding process can accurately be executed without any displacement of the folds.

On the other hand, the edge parts of the sheet having Z-fold are laid on or under the respective folds. However, when the plurality of additional folding rollers 114 are brought in so as to directly face the one of the folds, the corresponding edge part of the sheet is not found between the plurality of additional folding rollers 114 and the fold. Thus, the plurality of additional folding rollers 114 can directly apply pressing force onto the folds so that the pressing force is not dispersed and the folds can efficiently be strengthened. Particularly, while the layered sheet parts are liable to be displaced relative to each other until the first fold on the leading edge side of the sheet as viewed in the carry-in direction is additionally folded but, once the first fold is strengthened by an additional folding operation, the layered sheet parts will hardly be displaced. Therefore, a sheet S having Z-fold is preferably carried in with a positional relationship with which the plurality of additional folding rollers 114 can directly contact the first fold 132 and apply pressing force to it. In other words, the additional folding rollers 114 are preferably arranged on the side where they directly face the first fold 132 of the sheet S that is carried in.

Figure 9:
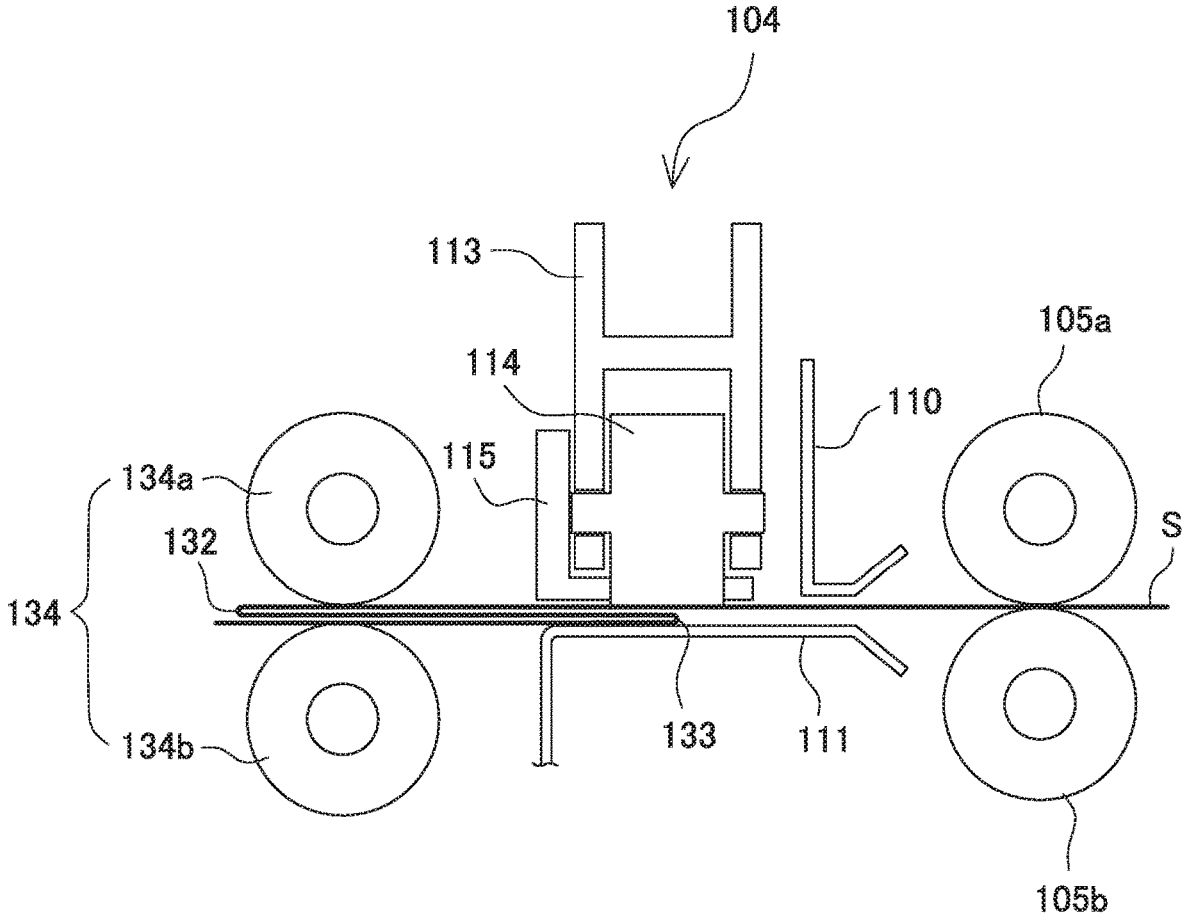
FIG. 9 is an explanatory graphic illustration of an embodiment of sheet folding processing device according to the present invention that is different from the embodiment shown in FIG. 2, illustrating the structure of the additional folding unit and its vicinity.

Additionally, as shown in FIG. 9, an additional conveyance roller pair 134 (a conveyance roller 134*a* and another conveyance roller 134*b*) may be arranged on the downstream side as viewed in the sheet conveyance direction to convey the sheet S, on which an additional folding process has been executed, further to the downstream side in order to minimize, if any, the displacement of the layered sheet parts. The conveyance roller pair 134 is arranged with such a positional relationship relative to the plurality of additional folding rollers 114 that a portion of the sheet part having the three layers of sheet produced by Z-folding is held between the conveyance roller pair 134, namely with such a positional relationship that a portion of the sheet part having the three layers of sheet are pinched between the conveyance roller pair 134, when the second fold 133 of the sheet S gets to below the plurality of additional folding rollers 114. When the plurality of additional folding rollers 114 and the conveyance roller pair 134 are arranged within a distance range shorter than the shortest distance between the first fold 132 and the second fold 133 as viewed in the conveyance direction of the sheet S with which the folding processing mechanism 103 can execute the folding process, the plurality of additional folding rollers 114 can execute an additional folding process on the second fold 133 while the conveyance roller pair 134 keeps on holding the sheet part having the three layers of sheet. In other words, the conveyance roller pair 134 operates as a pair of holding members that hold the sheet part having layers of sheet in an operation of executing an additional folding process on the second fold 133. With this arrangement, the plurality of additional folding rollers 114 can press the second fold 133 that has been formed by the folding roller pair 105 without producing any displacement of the sheet parts having the three layers of sheet so that an additional folding process can more accurately be executed without any displacement of the folds. The conveyance roller pair 134 may be provided as part of the sheet folding processing device B or as part of the post-processing device C arranged downstream relative to the sheet folding processing device B.

While a sheet processing device according to the present invention and an image forming system comprising such a sheet processing device are described above by way of an embodiment illustrated in the drawings, the present invention is by no means limited to the illustrated embodiment. For example, in the graphically illustrated embodiment, the first moving mechanism 116 comprises the guide rail 123, the slider 124, the bracket 125, the pulley 126, the rack 127, the additional folding drive motor 128, the belt 129, the contacts 130, the first inclined parts of the cam grooves 131 and the second inclined parts of the cam grooves 131, while the second moving mechanism 117 comprises the guide rail 123, the slider 124, the bracket 125, the pulley 126, the rack 127, the additional folding drive motor 128, the belt 129, the contacts 130 and the top horizontal parts of the cam grooves 131. However, the configuration of the first moving mechanism 116 and that of the second moving mechanism 117 are not subject to limitations so long as the support member 112 can be moved close to and away from the lower folding guide 111 and, at the same time, the support member 112 can be moved along the folds of the sheet S. For example, a linear motion mechanism may be adopted for the first moving mechanism 115 and another linear motion mechanism may be adopted for the second moving mechanism 117. While the additional folding rollers 114 are moved relative to the lower folding guide 111 by driving the additional folding rollers 114 to move in the embodiment shown in the drawings, the lower folding guide 111 may alternatively be moved relative to the additional folding rollers 114 by driving the lower folding guide 111. Of course, still alternatively, both the additional folding rollers 114 and the lower folding guide 111 may be moved. When the lower folding guide 111 is to be moved, the lower folding guide 111 may be provided with an elevation mechanism. Furthermore, instead of urging the additional folding rollers 114 by means of springs, the lower folding guide 111 may be urged toward the additional folding rollers 114 by means of one or more than one springs. Additionally, while the folding roller pair 105 is made to operate as a pair of holding members in the embodiment shown in the drawings, a pair of holding members that are different from the folding roller pair 105 may additionally be provided.

What is claimed is:

1. A sheet folding processing device for executing an additional folding process on a Z-fold sheet, a sheet being folded partly into three layers to have a plurality of folds formed by a folding process and being conveyed in a predetermined conveyance direction, the device comprising:

a folding processing section for forming a plurality of folds on a sheet;

an upper conveying guide for conveying the sheet to the folding processing section, having a horizontal portion extending horizontally and a bent portion bent downward from the horizontal portion toward a downstream side;

a lower conveying guide situated under the upper conveying guide;

a pair of holding members capable of holding the sheet having the plurality of the folds formed thereon;

a plurality of first press members arranged along a running direction of the folds on the downstream side relative to the pair of holding members as viewed in the conveyance direction;

a second press member arranged vis-a-vis the plurality of first press members to press the folds in cooperation with the plurality of first press members; and a moving mechanism for moving the first press members between a press position and a retreat position such that the moving mechanism moves the first press members relative to the second press member so as to bring it closer to the second press member until they get to the press position and press the folds arranged between the first press members and the second press member and then moves the first press members relative to the second press member from the press position to the retreat position in a direction of moving away from the sheet, and also for moving the first press members relative to the second press member along the folds in a state where the first press members have been moved relative to the second press member so as to get to the press position;

the interval between the pair of holding members and the first press members as viewed in the conveyance direction being so determined that, when a leading fold as viewed in the conveyance direction is pressed between the plurality of first press members located at the press position and the second press member, the sheet part where the sheet is folded to form the three layers in order to produce the Z-fold can be held between the pair of holding members.

2. The sheet folding processing device according to claim 1, wherein the folding processing section has a pair of folding rollers for forming folds on the sheet that is being conveyed and the pair of folding rollers operate as the pair of holding members.

3. The sheet folding processing device according to claim 1, wherein the first press members are rotating bodies that rotate around respective axes of rotation extending in the conveyance direction and press the folds.

4. The sheet folding processing device according to claim 1, wherein the plurality of first press members are arranged on a side facing a leading fold of the sheet as viewed in the sheet conveying direction.

5. The sheet folding processing device according to claim 1, wherein a pair of conveyance members are additionally provided on the downstream side of the plurality of first press members as viewed in the sheet conveying direction and the interval between the pair of conveyance members and the plurality of first press members in the sheet conveying direction is so determined that, in an operation of pressing a second fold being at downstream side of the leading fold as viewed in the sheet conveying direction between the plurality of first press members at the press position and the second press member, the sheet part where the sheet is folded between the plurality of first press members and the second press member to form a plurality of layers can also be held between the pair of conveyance members.

6. An image forming system comprising:

an image forming device for forming an image on a sheet and carrying out the sheet bearing the image formed thereon; and the sheet folding processing device according to claim 1 for executing the sheet folding process on the sheet carried out from the image forming device.

7. A sheet folding processing device for executing an additional folding process on a Z-fold sheet having a plurality of folds formed by a folding process and being conveyed in a predetermined conveyance direction, the device comprising:

a folding processing section for forming a plurality of folds on a sheet;

a pair of holding members capable of holding the sheet having the plurality of the folds formed thereon;

a plurality of first press members arranged in a row along a running direction of the folds on the downstream side relative to the pair of holding members as viewed in the conveyance direction;

a second press member arranged vis-a-vis the plurality of first press members to press the folds in cooperation with the plurality of first press members;

a moving mechanism for moving the first press members between a press position and a retreat position such that the moving mechanism moves the first press members relative to the second press member so as to bring it closer to the second press member until they get to the press position and press the folds arranged between the first press members and the second press member and then moves the first press members relative to the second press member from the press position to the retreat position in a direction of moving away from the sheet, and also for moving the first press members relative to the second press member along the folds in a state where the first press members have been moved relative to the second press member so as to get to the press position; and a plurality of restriction members arranged between the plurality of first press members, the restriction members restricting a thickness of the folds on the sheet under a predetermined thickness at a predetermined restriction position when the first press members move relative to the second press member along the folds by the moving mechanism at the press position, the interval between the pair of holding members and the first press members as viewed in the conveyance direction being so determined that, when a leading fold as viewed in the conveyance direction is pressed between the plurality of first press members located at the press position and the second press member, the sheet part where the sheet is folded to form the three layers in order to produce the Z-fold can be held between the pair of holding members.

8. The sheet folding processing device according to claim 7, wherein the folding processing section has a pair of folding rollers for forming folds on the sheet that is being conveyed and the pair of folding rollers operate as the pair of holding members.

9. The sheet folding processing device according to claim 7, wherein the first press members are rotating bodies that rotate around respective axes of rotation extending in the conveyance direction and press the folds.

10. The sheet folding processing device according to claim 7, wherein the plurality of first press members are arranged on the side facing the leading fold of the sheet as viewed in the sheet conveying direction.

11. The sheet folding processing device according to claim 7, wherein a pair of conveyance members are additionally provided on the downstream side of the plurality of first press members as viewed in the sheet conveying direction and the interval between the pair of conveyance members and the plurality of first press members in the sheet conveying direction is so determined that, in an operation of pressing a second fold being at downstream side of the leading fold as viewed in the sheet conveying direction between the plurality of first press members at the press position and the second press member, the sheet part where the sheet is folded between the plurality of first press members and the second press member to form a plurality of layers can also be held between the pair of conveyance members.

12. An image forming system comprising:

an image forming device for forming an image on a sheet and carrying out the sheet bearing the image formed thereon; and a sheet folding processing device according to claim 7 for executing a sheet folding process on the sheet carried out from the image forming device.

* * * * *